US008524428B2

(12) United States Patent
Nakamura

(10) Patent No.: US 8,524,428 B2
(45) Date of Patent: Sep. 3, 2013

(54) ELECTROPHOTOGRAPHIC PHOTORECEPTOR, PROCESS CARTRIDGE, AND IMAGE FORMING APPARATUS

(75) Inventor: Hirofumi Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 269 days.

(21) Appl. No.: 12/875,626

(22) Filed: Sep. 3, 2010

(65) Prior Publication Data

US 2011/0183242 A1 Jul. 28, 2011

(30) Foreign Application Priority Data

Jan. 22, 2010 (JP) ..... 2010-012246

(51) Int. Cl.
*G03G 5/06* (2006.01)

(52) U.S. Cl.
USPC ..... 430/58.7; 430/58.8; 430/58.85; 430/66; 430/58.5

(58) Field of Classification Search
USPC ..... 430/58.7, 58.8, 58.85, 66, 58.5; 399/159
See application file for complete search history.

(56) References Cited

U.S. PATENT DOCUMENTS

| | | | | |
|---|---|---|---|---|
| 4,818,650 | A | 4/1989 | Limburg et al. | |
| 4,956,440 | A | 9/1990 | Limburg et al. | |
| 5,445,909 | A * | 8/1995 | Akasaki et al. | 430/58.8 |
| 5,547,790 | A * | 8/1996 | Umeda et al. | 430/58.2 |
| 5,800,950 | A * | 9/1998 | Hirao et al. | 430/1 |
| 5,824,444 | A * | 10/1998 | Kinoshita et al. | 430/57.3 |
| 5,932,384 | A * | 8/1999 | Mitsumori et al. | 430/58.8 |
| 6,027,848 | A * | 2/2000 | Pai et al. | 430/119.72 |
| 6,090,511 | A * | 7/2000 | Yang et al. | 430/57.2 |
| 6,150,063 | A * | 11/2000 | Sugimura et al. | 430/58.35 |
| 6,150,065 | A * | 11/2000 | Kobayashi et al. | 430/83 |
| 6,210,848 | B1 * | 4/2001 | Nagai et al. | 430/58.7 |
| 6,379,853 | B1 * | 4/2002 | Lin et al. | 430/58.45 |
| 6,790,572 | B2 * | 9/2004 | Tamoto et al. | 430/58.05 |
| 6,858,362 | B2 * | 2/2005 | Tamoto et al. | 430/59.6 |
| 7,018,763 | B2 * | 3/2006 | Matsumoto et al. | 430/108.7 |
| 7,060,404 | B2 * | 6/2006 | Kami et al. | 430/57.2 |
| 7,127,196 | B2 * | 10/2006 | Kami et al. | 399/159 |

(Continued)

FOREIGN PATENT DOCUMENTS

| | | |
|---|---|---|
| JP | A-56-51749 | 5/1981 |
| JP | A-60-247647 | 12/1985 |
| JP | A-64-1728 | 1/1989 |
| JP | A-4-281461 | 10/1992 |
| JP | A-5-99737 | 4/1993 |
| JP | A-8-278645 | 10/1996 |
| JP | A-2000-292959 | 10/2000 |
| JP | A-2001-255685 | 9/2001 |
| JP | A-2002-82469 | 3/2002 |
| JP | A-2003-186222 | 7/2003 |
| JP | A-2003-186234 | 7/2003 |

OTHER PUBLICATIONS

"The Fourth Series of Experimental Chemistry," May 6, 1992, pp. 430-431, vol. 28, Kumao Ebihara (w/ English translation).

*Primary Examiner* — Christopher Rodee
(74) *Attorney, Agent, or Firm* — Oliff & Berridge, PLC

(57) ABSTRACT

An electrophotographic photoreceptor includes: a conductive substrate; a photosensitive layer including a charge-generating layer containing a charge-generating material and a charge-transporting layer containing a charge-transporting material, the charge-transporting layer having a hole mobility of about $5.0\times10^{-6}$ ($cm^2/V\cdot sec$) or less at an electric field of 2 V/cm; and an overcoat layer that is provided on the photosensitive layer and contains a cured material of a charge-transporting material, wherein relational expression (1) Ip(OCL)>Ip(CTL)>Ip(CGL) is satisfied wherein Ip(CGL) represents an ionization potential (eV) of the charge-generating material contained in the charge-generating layer; Ip(CTL) represents an ionization potential (eV) of the charge-transporting material contained in the charge-transporting layer; and Ip(OCL) represents an ionization potential (eV) of the charge-transporting material contained in the overcoat layer.

12 Claims, 3 Drawing Sheets

(56) References Cited

U.S. PATENT DOCUMENTS

| | | | | |
|---|---|---|---|---|
| 7,547,498 | B2 * | 6/2009 | Yamane et al. | 430/108.6 |
| 7,838,191 | B2 * | 11/2010 | Kuboshima et al. | 430/78 |
| 8,084,170 | B2 * | 12/2011 | Kami et al. | 430/59.6 |
| 8,178,266 | B2 * | 5/2012 | Tada et al. | 430/58.85 |
| 2001/0031412 | A1 * | 10/2001 | Itami et al. | 430/58.15 |
| 2002/0119382 | A1 | 8/2002 | Nakata et al. | |
| 2003/0148199 | A1 * | 8/2003 | Shindoh et al. | 430/58.85 |
| 2003/0215264 | A1 * | 11/2003 | Yasutomi et al. | 399/159 |
| 2008/0299472 | A1 * | 12/2008 | DeJong et al. | 430/58.05 |
| 2009/0185821 | A1 * | 7/2009 | Iwamoto et al. | 399/111 |
| 2009/0324281 | A1 * | 12/2009 | Tada et al. | 399/111 |
| 2010/0150606 | A1 * | 6/2010 | Tamoto et al. | 399/111 |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-012246 filed Jan. 22, 2010.

BACKGROUND

1. Technical Field

The present invention relates to an electrophotographic photoreceptor, a process cartridge, and an image forming apparatus.

2. Related Art

A resin with a high mechanical strength has been used for an electrophotographic photoreceptor in recent years, and attempts have been made to elongate the life-span thereof.

SUMMARY

According to an aspect of the invention, there is provided an electrophotographic photoreceptor including:

a conductive substrate;

a photosensitive layer including a charge-generating layer containing a charge-generating material and a charge-transporting layer containing a charge-transporting material, the charge-transporting layer having a hole mobility of about $5.0\times10^{-6}$ ($cm^2/V\cdot sec$) or less at an electric field of 2 V/cm; and an overcoat layer that is provided on the photosensitive layer and contains a cured material of a charge-transporting material, wherein the following relational expression (1) is satisfied $$Ip(OCL)>Ip(CTL)>Ip(CGL) \quad (1)$$

wherein Ip(CGL) represents an ionization potential (eV) of the charge-generating material contained in the charge-generating layer; Ip(CTL) represents an ionization potential (eV) of the charge-transporting material contained in the charge-transporting layer; and Ip(OCL) represents an ionization potential (eV) of the charge-transporting material contained in the overcoat layer.

BRIEF DESCRIPTION OF THE DRAWINGS

Exemplary embodiment of the present invention will be described in detail based on the following figures, wherein.

DETAILED DESCRIPTION

Figure 1:
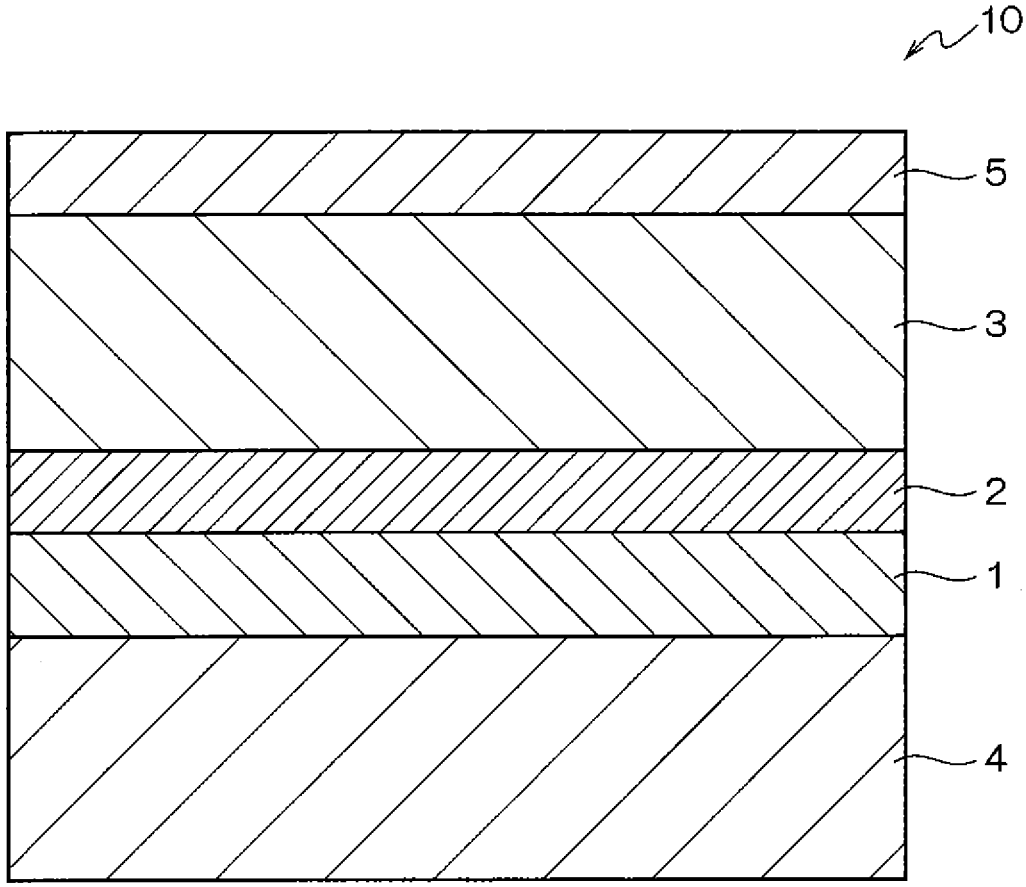
FIG. 1 is a schematic partial sectional view illustrating an electrophotographic photoreceptor according to an exemplary embodiment.

Hereinafter, the description will be made of an exemplary embodiment as an example of the present invention.

(Electrophotographic Photoreceptor)

The electrophotographic photoreceptor according to the exemplary embodiment includes: a conductive substrate; a photosensitive layer provided on the conductive substrate; and an overcoat layer provided on the photosensitive layer.

The photosensitive layer includes a charge-generating layer and a charge-transporting layer. The charge-generating layer contains a charge-generating material. The charge-transporting layer contains a charge-transporting material. On the other hand, the overcoat layer contains a cured material of a charge-transporting material.

Further, when an ionization potential (eV) of the charge-generating material contained in the charge-generating layer is represented by Ip(CGL), an ionization potential (eV) of the charge-transporting material contained in the charge-transporting layer is represented by Ip(CTL), and an ionization potential (eV) of the charge-transporting material contained in the overcoat layer is represented by Ip(OCL), the following relational expression (1) is satisfied, and a hole mobility of the charge-transporting layer at an electric field of 2 V/cm is $5.0\times10^{-6}$ ($cm^2/V\cdot sec$) (or about $5.0\times10^{-6}$ ($cm^2/V\cdot sec$)) or less.

$$Ip(OCL)>Ip(CTL)>Ip(CGL) \quad \text{Relational Expression (1)}$$

Since the charge-transporting layer and the overcoat layer in a general electrophotographic photoreceptor are hole-transporting layers, it has been considered that it is desirable to satisfy the following relational expression (4).

$$Ip(OCL)\leqq Ip(CTL)\leqq Ip(CGL) \quad \text{Relational Expression (4)}$$

It has been considered that it is desirable to satisfy this relational expression (4) based on the idea that it is possible to enhance the electric properties by making the charge injection smooth at an interface between the charge-generating layer and the charge-transporting layer and at an interface between the charge-transporting layer and the overcoat layer.

In an electrophotographic photoreceptor having an overcoat layer constituted by a cured material of a charge-transporting material (a so-called cured overcoat layer), however, it has been found that when not the relational expression (4) but the relational expression (1) is satisfied, more excellent properties may be achieved regarding long-term maintenance of the electric properties, in particular, regarding the suppression of the increase in the residual potential. The details thereof have not been clarified, but the following reason has been considered so far.

When a functional group as a reaction residue or a residual radical remains in the cured material in the cured overcoat layer, the charge-transporting ability of the cured overcoat layer tends to be degraded as compared with that of the charge-transporting layer. It is expected that when there is a gap between the charge-transporting abilities, the charge is accumulated at the interface between the charge-transporting layer and the overcoat layer, and the internal electric field at the interface becomes high. It is considered that if the state in which the internal electric field is high continues for a long time, or if the state in which the internal electric field is high occurs repeatedly due to electrophotographic processes, the charge-transporting materials at the interface between the charge-transporting layer and the overcoat layer are deteriorated, and as a result, the electric properties are degraded, in particular, the increase in the residual potential occurs.

For this reason, it is considered that it is possible to enhance the long-term maintenance of the electric properties, in particular, it is possible to suppress the increase in the residual potential by making the charge movement within the photoreceptor (the charge-generating layer, the charge-transporting layer, and the overcoat layer) slow.

Accordingly, the setting of the hole mobility of the charge-transporting layer at an electric field of 2 V/cm to be $5.0\times10^{-6}$ ($cm^2/V\cdot sec$) or less and the selecting of the constituent materials for the respective layers so as to satisfy the relational expression (1) mean that the charge movement in the photoreceptor (the charge-generating layer, the charge-transporting layer, and the overcoat layer) is made to be slower. As a result, it is possible to suppress the increase in the residual potential in the electrophotographic photoreceptor according to the exemplary embodiment. In addition, it is considered that the state may be readily maintained for a long time.

In the process cartridge and the image forming apparatus provided with the electrophotographic photoreceptor according to the exemplary embodiment, it is possible to suppress image defects (such as fogging (a phenomenon in which a density becomes high because of the adhesion of a toner to a non-image portion)) caused by the increase in the residual potential.

In particular, when the process speed (a transport velocity of a transfer medium) is slow (for example, when the process speed is 75 mm/s or less) in the process cartridge or the image forming apparatus, the state in which the internal electric field is high tends to continue for a long time. Therefore, the residual potential in the electrophotographic photoreceptor tends to be increased, and as a result, the generation of fogging tends to occur. However, it is possible to easily suppress the generation of the fogging by applying the electrophotographic photoreceptor according to the exemplary embodiment.

Further, the following relational expressions (2) and (3) may be satisfied in addition to the above relational expression (1) in the electrophotographic photoreceptor according to the exemplary embodiment. Further, the following relational expressions (2-1) and (3-1) may be satisfied.

The following relational expressions (2) and (3) mean that the charge moving velocities in the charge-generating layer, the charge-transporting layer, and the overcoat layer are close to each other. In other words, the following relational expressions mean that the charge moving velocities are close to the charge moving velocity in the overcoat layer. Accordingly, the increase in the residual potential is readily suppressed.

$$|Ip(OCL)-Ip(CTL)|\leqq 0.4\ (eV) \qquad \text{Relational Expression (2)}$$

$$|Ip(CTL)-Ip(CGL)|\leqq 0.3\ (eV) \qquad \text{Relational Expression (3)}$$

$$|Ip(OCL)-Ip(CTL)|\leqq 0.3\ (eV) \qquad \text{Relational Expression (2-1)}$$

$$|Ip(CTL)-Ip(CGL)|\leqq 0.2\ (eV) \qquad \text{Relational Expression (3-1)}$$

In addition, from the viewpoint of suppressing the increase in the residual potential, the hole mobility of the charge-transporting layer at an electric field of 2 V/cm may be $3.0\times 10^{-6}$ ($cm^2/V\cdot sec$) or more.

Here, the ionization potential is a value obtained using the atmosphere photoelectron spectroscopy equipment AC-2 manufactured by Riken Keiki Co., Ltd.

In addition, the hole mobility is a value measured using TOF-401 (excitation light source: nitrogen pulse laser (wavelength; 337 nm), applied voltage; 2 V/cm) manufactured by Sumitomo Heavy Industries, Ltd. based on a Time of Flight method (TOF method) under normal temperature and humidity of 20° C./40% RH.

For example, a material with an intended ionization potential is selected to satisfy the above relational expressions in the electrophotographic photoreceptor according to the exemplary embodiment. In addition, when two or more types of materials are applied to each layer, the above relational expressions may be satisfied by a material with the lowest ionization potential.

In addition, a material with an intended hole mobility is selected in order to allow the hole mobility of the charge-transporting layer to be in the above range.

Hereinafter, more detailed description will be made of the electrophotographic photoreceptor according to the exemplary embodiment.

FIG. 1 schematically shows a partial section of an electrophotographic photoreceptor 10 according to the exemplary embodiment.

The electrophotographic photoreceptor 10 shown in FIG. 1 is provided with an undercoating layer 1 on a conductive substrate 4, a charge-generating layer 2 and a charge-transporting layer 3 as the photosensitive layer on the undercoating layer, and further an overcoat layer 5 as the uppermost surface layer.

Hereinafter, the respective components will be described based on the electrophotographic photoreceptor 10. In addition, the reference numerals will be omitted in the description.

—Conductive Substrate—

Any conductive substrate may be used such as the conductive substrate which has been conventionally used. Examples thereof include a plastic film provided with a thin film (for example, metals such as aluminum, nickel, chromium, or stainless steel, a film of aluminum, titanium, nickel, chromium, stainless steel, gold, vanadium, tin oxide, indium oxide, or indium tin oxide (ITO)), a paper coated or impregnated with a conductivity-imparting agent, and a plastic film coated or impregnated with a conductivity-imparting agent. The shape of the substrate is not limited to a cylindrical shape and may be a sheet shape or a plate shape.

When a metal pipe is used as the conductive substrate, the surface thereof may be or may not be subjected to a process such as mirror grinding, etching, anodizing, rough grinding, centerless grinding, sandblasting, or wet honing.

—Undercoating Layer—

The undercoating layer is provided, if necessary, in order to prevent the light reflection at the surface of the conductive substrate, or to prevent the unnecessary carrier injection from the conductive substrate to the photosensitive layer.

The undercoating layer includes a binder resin and, if necessary, other additives, for example.

Examples of the binder resin contained in the undercoating layer include a known polymer resin compound such as an acetal resin such as polyvinyl butyral, a polyvinyl alcohol, casein, a polyamide, a cellulose resin, gelatin, a polyurethane, a polyester, a methacrylic resin, an acrylic resin, a polyvinyl chloride resin, a polyvinyl acetate, a vinyl chloride-vinyl acetate-maleic anhydride resin, a silicone resin, a silicone-alkyd resin, a phenol resin, a phenol-formaldehyde resin, or a melamine resin, a charge-transporting resin having a charge-transporting group, and a conductive resin such as polyaniline. Among these examples, a resin, which is insoluble in the coating solvent for the upper layer, may be employed. In particular, a phenol resin, a phenol-formaldehyde resin, a melamine resin, a urethane resin, or an epoxy resin, for example, may be employed.

The undercoating layer may contain, for example, a metal compound such as a silicon compound, an organic zirconium compound, an organic titanium compound, or an organic aluminum compound.

The ratio between the metal compound and the binder resin is not particularly limited and is arbitrarily set in a range in which a desirable characteristic of the electrophotographic photoreceptor may be obtained.

Resin particles may be added in the undercoating layer in order to adjust the surface roughness of the undercoating layer. Examples of the resin particles include silicone resin particles, and cross-linked poly methyl methacrylate (PMMA) resin particles. In addition, the surface of the undercoating layer may be polished after the formation in order to adjust the surface roughness. As a polishing method, buffing, a sandblasting process, wet honing, a grinding process, for example, is employed.

Here, an example of the configuration of the undercoating layer is one containing at least a binder resin and conductive particles. For example, conductive particles having a volume resistivity of less than $10^7$ Ω·cm may be used.

Examples of the conductive particles include, for example, metal particles (particles of aluminum, copper, nickel, silver, or the like), conductive metal oxide particles (particles of antimony oxide, indium oxide, tin oxide, zinc oxide, or the like), and conductive material particles (particles of carbon fiber, carbon black, graphite powders, or the like). Among these examples, conductive metal oxide particles may be used. The conductive particles may be used in a combination of two or more types.

In addition, the resistance of the conductive particles may be adjusted by surface treatment using a hydrophobizing treatment agent (such as a coupling agent) or the like.

The content of the conductive particles may be in a range from 10% by weight to 80% by weight, or in a range from 40% by weight to 80% by weight, with respect to the binder resin.

When the undercoating layer is formed, a coating liquid for forming the undercoating layer, which is obtained by adding the above components to a solvent, is used.

In addition, as a method for dispersing the particles into the coating liquid for forming the undercoating layer, a media disperser such as a ball mill, a vibration ball mill, an attritor, a sand mill, or a horizontal sand mill, or a medialess disperser such as agitation, an ultrasonic disperser, a roll mill, or a high-pressure homogenizer is used. Examples of the high-pressure homogenizer system include a collision system in which the particles are dispersed by causing the dispersion liquid to collide against liquid or against walls under a high pressure, and a penetration system in which the particles are dispersed by causing the dispersion liquid to penetrate through a fine flow path under a high pressure.

Examples of a method for coating the conductive substrate with the coating liquid for forming the undercoating layer include a dip-coating method, a push-up coating method, a wire-bar coating method, a spray coating method, a blade coating method, a knife coating method, and a curtain coating method.

The layer thickness of the undercoating layer may be 15 μm or more, or from 20 μm to 50 μm.

Although not shown in the drawing, an intermediate layer may be further provided between the undercoating layer and the photosensitive layer. Examples of the binder resin used for the intermediate layer include a polymer resin compound such as an acetal resin such as polyvinyl butyral, a polyvinyl alcohol, casein, a polyamide, a cellulose resin, gelatin, a polyurethane, a polyester, a methacrylic resin, an acrylic resin, a polyvinyl chloride, a polyvinyl acetate, a vinyl chloride-vinyl acetate-maleic anhydride resin, a silicone resin, a silicone-alkyd resin, a phenol-formaldehyde resin, or a melamine resin, an organic metal compound containing zirconium, titanium, aluminum, manganese, or silicon atoms. The compound may be used alone or as a mixture or a polycondensation product of plural compounds. Among them, the organic metal compound containing zirconium or silicon may be used from the viewpoint that such an organic metal compound has a low residual potential and exhibits less potential change due to the environment or due to the repeated usage thereof.

When the intermediate layer is formed, a coating liquid for forming the intermediate layer obtained by adding the above components to a solvent is used.

As a coating method for forming the intermediate layer, an ordinary method such as a dip-coating method, a push-up coating method, a wire-bar coating method, a spray coating method, a blade coating method, a knife coating method, or a curtain coating method is employed.

The intermediate layer functions to improve the coating property of the upper layer, and in addition, the intermediate layer functions as an electrically-blocking layer. When the layer thickness thereof is excessively large, however, the electrical blocking functions too strongly, which results in a decrease in the sensitivity or in an increase in the potential due to the repeated usage, in some cases. Accordingly, when the intermediate layer is formed, the thickness may be in a range from 0.1 μm to 3 μm. In addition, the intermediate layer in this case may be used as the undercoating layer.

—Charge-Generating Layer—

The charge-generating layer includes, for example, a charge-generating material and a binder resin. Examples of the charge-generating material include a phthalocyanine pigment such as metal-free phthalocyanine, chlorogallium phthalocyanine, hydroxygallium phthalocyanine, dichlorotin phthalocyanine, or titanyl phthalocyanine. In particular, examples thereof include chlorogallium phthalocyanine crystals which have main diffraction peak intensities at the Bragg angles (2θ±0.2°) of at least 7.4°, 16.6°, 25.5°, and 28.3° with respect to CuKα, characteristic X-rays, metal-free phthalocyanine crystals which have main diffraction peak intensities at the Bragg angles (2θ±0.2°) of at least 7.7°, 9.3°, 16.9°, 17.5°, 22.4°, and 28.8° with respect to CuKα characteristic X-rays, hydroxygallium phthalocyanine crystals which have main diffraction peak intensities at the Bragg angles (2θ±0.2°) of at least 7.5°, 9.9°, 12.5°, 16.3°, 18.6°, 25.1°, and 28.3° with respect to CuKα characteristic X-rays, titanyl phthalocyanine crystals which have main diffraction peak intensities at the Bragg angles (2θ±0.2°) of at least 9.6°, 24.1°, and 27.2° with respect to CuKα characteristic X-rays, and titanyl phthalocyanine crystals which have main diffraction peak intensities at the Bragg angles (2θ±0.2°) of at least 7.6°, 18.3°, 23.2°, 24.2°, and 27.3° with respect to CuKα characteristic X-rays. In addition, examples of the charge-generating material include a quinine pigment, a perylene pigment, an indigo pigment, a bisbenzo-imidazole pigment, an anthrone pigment, and a quinacridone pigment. In addition, these charge-generating materials may be used alone or in a mixture of two or more types.

Among above examples, hydroxygallium phthalocyanine crystals which have main diffraction peak intensities at the Bragg angles (2θ±0.2°) of at least 7.5°, 9.9°, 12.5°, 16.3°, 18.6°, 25.1°, and 28.3° with respect to CuKα characteristic X-rays, and titanyl phthalocyanine crystals which have main diffraction peak intensities at the Bragg angles (2θ±0.2°) of at least 7.6°, 18.3°, 23.2°, 24.2°, and 27.3° with respect to CuKα characteristic X-rays may be used.

Examples of the binder resin used for the charge-generating layer include a polycarbonate resin such as bisphenol A type, or bisphenol Z type, an acrylic resin, a methacrylic resin, a polyarylate, a polyester, a polyvinyl chloride, a polystyrene, an acrylonitrile-styrene copolymer resin, an acrylonitrile-butadiene copolymer, a polyvinyl acetate resin, a polyvinyl formal resin, a polysulfone, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide, a polyamide, and poly-N-vinyl carbazole. These binder resins may be used alone or used in a mixture of two or more kinds.

In addition, the ratio of the charge-generating material and the binder resin may be in the range from 10:1 to 1:10, for example.

When the charge-generating layer is formed, a coating liquid for forming the charge-generating layer obtained by adding the above components to a solvent is used.

As a method for dispersing the particles (for example, the charge-generating material) into the coating liquid for forming the charge-generating layer, a media disperser such as a ball mill, a vibration ball mill, an attritor, a sand mill, or a horizontal sand mill, or a medialess disperser such as agitation, an ultrasonic disperser, a roll mill, or a high-pressure homogenizer, is used. Examples of the high-pressure homogenizer system include a collision system in which the particles are dispersed by causing the dispersion liquid to collide against liquid or against walls under a high pressure, and a penetration system in which the particles are dispersed by causing the dispersion liquid to penetrate through a fine flow path under a high pressure.

Examples of a method for coating the undercoating layer with the coating liquid for forming the charge-generating layer include a dip-coating method, a push-up coating method, a wire-bar coating method, a spray coating method, a blade coating method, a knife coating method, and a curtain coating method.

The layer thickness of the charge-generating layer may be from 0.01 μm to 5 μm, or from 0.05 μm to 2.0 μm.

—Charge-Transporting Layer—

The charge-transporting layer includes a charge-transporting material and, if necessary, a binder resin.

Examples of the charge-transporting material include an oxadiazole derivative such as 2,5-bis(p-diethylaminophenyl)-1,3,4-oxadiazol, a pyrazoline derivative such as 1,3,5-triphenyl-pyrazoline, or 1-[pyridyl-(2)]-3-(p-diethylaminostyryl)-5-(p-diethylaminostyryl)pyrazoline, an aromatic tertiary amino compound such as triphenylamine, N,N'-bis(3,4-dimethylphenyl)biphenyl-4-amine, tri(p-methylphenyl)aminyl-4-amine, or dibenzylaniline, an aromatic tertiary diamino compound such as N,N'-bis(3-methylphenyl)-N,N'-diphenylbenzidine, a 1,2,4-triazine derivative such as 3-(4'-dimethylaminophenyl)-5,6-di-(4'-methoxyphenyl)-1,2,4-triazine, a hydrazone derivative such as 4-diethylaminobenzaldehyde-1,1-diphenylhydrazone, a quinazoline derivative such as 2-phenyl-4-styryl-quinazoline, a benzofuran derivative such as 6-hydroxy-2,3-di(p-methoxyphenyl)benzofuran, an α-stilbene derivative such as p-(2,2-diphenylvinyl)-N,N-diphenylaniline, an enamine derivative, a carbazole derivative such as N-ethylcarbazole, a hole transporting material such as poly-N-vinylcarbazole, or a derivative thereof, a quinone compound such as chloranil, or bromoanthraquinone, a tetracyanoquinodimethane compound, a fluorenone compound such as 2,4,7-trinitrofluorenone, or 2,4,5,7-tetranitro-9-fluorenone, an electron transporting material such as a xanthone compound, or a thiophene compound, a polymer having a group constituted by the above compound at a main chain or a side chain. These charge-transporting materials may be used alone or in combination of two or more kinds.

Among them, as the charge-transporting material, a triarylamine derivative represented by the following structural formula (α-1) and a benzidine derivative represented by the following structural formula (α-2) may be used.

(α-1)

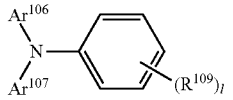

In the above structural formula (α-1), $R^{109}$ represents a hydrogen atom or a methyl group. l represents 1 or 2. $Ar^{106}$ and $Ar^{107}$ each independently represent a substituted or unsubstituted aryl group, $—C_6H_4—C(R^{110})=C(R^{111})(R^{112})$ or $—C_6H_4—CH=CH—CH=C(R^{113})(R^{114})$, and $R^{110}$ to $R^{114}$ each independently represent a hydrogen atom, a substituted or unsubstituted alkyl group, or a substituted or unsubstituted aryl group.

Here, examples of a substituent of the above respective groups include a halogen atom, an alkyl group having from 1 to 5 carbon atoms, an alkoxy group having from 1 to 5 carbon atoms, and a substituted amino group substituted with an alkyl group having from 1 to 3 carbon atoms.

(α-2)

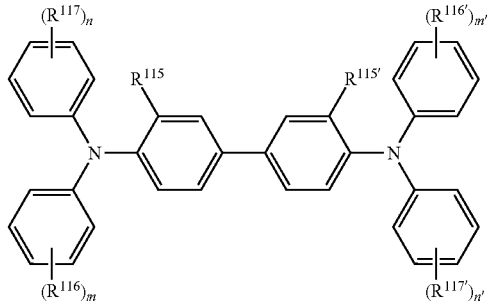

In the above structural formula (α-2), $R^{115}$ and $R^{115'}$ each independently represent a hydrogen atom, a halogen atom, an alkyl group having from 1 to 5 carbon atoms, or an alkoxy group having from 1 to 5 carbon atoms. $R^{116}$, $R^{116'}$, $R^{117}$, and $R^{117'}$ each independently represent a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, $—C(R^{118})=C(R^{119})(R^{120})$, or $—CH=CH—CH=C(R^{121})(R^{122})$, and $R^{118}$ to $R^{122}$ each independently represent a hydrogen atom, a substituted or unsubstituted alkyl group, or a substituted or unsubstituted aryl group. m, m', n and n' each independently represent an integer from 0 to 2.

Here, among the triarylamine derivative represented by the above structural formula (α-1) and the benzidine derivative represented by the above structural formula (α-2), the triarylamine derivative having "$—C_6H_4—CH=CH—CH=C(R^{113})(R^{114})$" and the benzidine derivative having "$—CH=CH—CH=C(R^{121})(R^{122})$" may be selected.

Examples of the binder resin used for the charge-transporting layer include a polycarbonate resin such as bisphenol A type, or bisphenol Z type, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, an insulating resin such as chlorine rubber, an organic photoconductive polymer such as polyvinylcarbazole, polyvinyl anthracene, or polyvinylpyrene. These binder resins may be used alone or used in a mixture of two or more kinds.

In addition, the ratio of the charge-transporting material and the binder resin may be in the range from 10:1 to 1:5, for example.

The charge-transporting layer is formed using a coating liquid for forming a charge-transporting layer which is obtained by adding the above components to a solvent.

Examples of a method for coating the charge-generating layer with the coating liquid for forming the charge-transporting layer include ordinary methods such as a dip-coating method, a push-up coating method, a wire-bar coating method, a spray coating method, a blade coating method, a knife coating method, and a curtain coating method.

The layer thickness of the charge-transporting layer may be set in a range from 5 μm to 50 μm, or from 10 μm to 40 μm.

—Overcoat Layer—

The overcoat layer includes a cured material of a charge-transporting material. Specifically, the overcoat layer may be constituted by a cured material of a curable resin composition including a curable resin and a charge-transporting material, for example.

The curable resin is a cross-linkable resin which forms a network structure of polymers after being polymerized by heating or a light beam, and which maintains its cured state. As a curable resin, a thermosetting resin may be used.

Examples of the thermosetting resin include a melamine resin, a phenol resin, a urea resin, a benzoguanamine resin, an epoxy resin, an unsaturated polyester resin, an alkyd resin, polyurethane, a polyimide resin, and a curable acrylic resin. However, the thermosetting resin is not limited thereto. These thermosetting resins may be used alone or in combination of two or more kinds.

Although the charge-transporting material is not particularly limited, a charge-transporting material which is compatible with a curable resin may be used, and a charge-transporting material which forms a chemical bond with a curable resin to be used may be used. Examples of the charge-transporting organic compound having a reactive functional group which forms a chemical bond with the curable resin include the one having at least one substituent selected from —OH, —$OCH_3$, —$NH_2$, —SH, and —COOH.

Here, the overcoat layer may contain a cured material of at least one compound and at least one charge-transporting material, the at least one compound being selected from the group consisting of guanamine compounds and melamine compounds, the at least one charge-transporting material having at least one substituent selected from the group consisting of —OH, —$OCH_3$, —$NH_2$, —SH, and —COOH, wherein a content of the at least one compound in the overcoat layer may be in a range from 0.1% by weight (or about 0.1% by weight) to 5% by weight (or about 5% by weight), and a content of the at least one charge-transporting material in the overcoat layer may be in a range from 90% by weight (or about 90% by weight) to less than 99.9% by weight (or about 99.9% by weight).

That is, the overcoat layer may contain a cured material of at least one compound and at least one charge-transporting material, the at least one compound being selected from the group consisting of guanamine compounds and melamine compounds, the at least one charge-transporting material having at least one substituent selected from the group consisting of —OH, —$OCH_3$, —$NH_2$, —SH, and —COOH. That is, the overcoat layer may contain a cured material prepared using a coating liquid containing at least one compound and at least one charge-transporting material, the at least one compound being selected from the group consisting of guanamine compounds and melamine compounds, the at least one charge-transporting material having at least one substituent selected from the group consisting of —OH, —$OCH_3$, —$NH_2$, —SH, and —COOH (hereinafter, also referred to as a "specific charge-transporting material"), wherein a content of the at least one compound in the solid components of the coating liquid is in a range from 0.1% by weight to 5% by weight, and a content of the at least one charge-transporting material in the solid components of the coating liquid is in a range from 90% by weight to less than 99.9% by weight.

In the overcoat layer containing the cured material, the above respective relational expressions are satisfied, and it is possible to implement film thickening while securing the charge-transporting ability. For this reason, it is possible to extend the lifespan even if the electrophotographic photoreceptor is applied to an image forming apparatus which is used while grinding the overcoat layer in order to remove adhering substances on the surface (for example, discharge products).

First, the description will be made of the guanamine compound.

The guanamine compound is a compound having a guanamine skeleton (structure). Examples of the guanamine compound include acetoguanamine, benzoguanamine, formoguanamine, steroguanamine, spiroguanamine, and cyclohexyl guanamine.

Particularly, the guanamine compound may be at least one of a compound represented by the following formula (A) or an oligomer thereof. Here, the oligomer is an oligomer in which the compound represented by the formula (A) is polymerized as a structural unit. The polymerization degree thereof is from 2 to 200 (or from 2 to 100), for example. The compound represented by the formula (A) may be used alone or may be used in combination of two or more kinds. In particular, when the compound represented by the formula (A) is used in combination of two or more kinds, or when the oligomer having the compound as its structural unit is used, it is possible to enhance the solubility in the solvent.

(A)

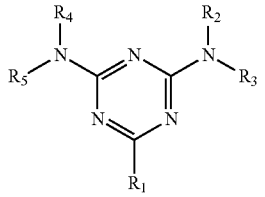

In formula (A), $R_1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. $R_2$ to $R_5$ each independently represent hydrogen atom, —$CH_2$—OH, or —$CH_2$—O—$R_6$. $R_6$ represents a linear or branched alkyl group having from 1 to 10 carbon atoms.

In the formula (A), the alkyl group represented by $R_1$ has from 1 to 10 carbon atoms. However, the alkyl group may have from 1 to 8 carbon atoms, or from 1 to 5 carbon atoms. In addition, the alkyl group may be a linear or branched alkyl group.

In the formula (A), the phenyl group represented by $R_1$ has from 6 to 10 carbon atoms. However, the phenyl group may have 6 to 8 carbon atoms. Examples of the substituent in the phenyl group include a methyl group, an ethyl group, and a propyl group.

In the formula (A), the alicyclic hydrocarbon group represented by $R_1$ has from 4 to 10 carbon atoms. However, the alicyclic hydrocarbon group may have 5 to 8 carbon atoms. Example of the substituent in the alicyclic hydrocarbon group include a methyl group, an ethyl group, and a propyl group.

In the "—$CH_2$—O—$R_6$" represented by $R_2$ to $R_5$ in the formula (A), the alkyl group represented by $R_6$ has from 1 to 10 carbon atoms. However, the alkyl group may have from 1 to 8 carbon atoms, or from 1 to 6 carbon atoms. In addition, the alkyl group may be a linear or branched alkyl group. Examples of the alkyl group include a methyl group, an ethyl group, and a butyl group.

In the compound represented by the formula (A), $R_1$ may represent a substituted or unsubstituted phenyl group having from 6 to 10 carbon atoms, and $R_2$ to $R_5$ may each independently represent —$CH_2$—O—$R_6$. In addition, $R_6$ may be selected from a methyl group or an n-butyl group.

The compound represented by the formula (A) is synthesized by a known method using, for example, guanamine and formaldehyde (for example, The Fourth Series of Experimental Chemistry, Vol. 28, pp. 430, edited by The Chemical Society of Japan).

Hereinafter, exemplified compounds: (A)-1 to (A)-42 will be shown as specific examples of the compound represented by the formula (A). However, the exemplary embodiment is not limited thereto. In addition, although the following specific examples show monomers, the compounds may be oligomers having these monomers as structural units. In addition, in the following exemplified compounds, "Me" represents a methyl group, "Bu" represents a butyl group, and "Ph" represents a phenyl group, respectively.

(A)-1

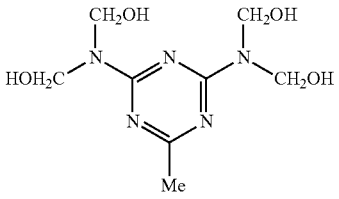

(A)-2

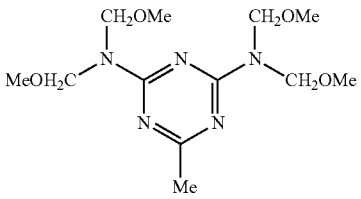

(A)-3

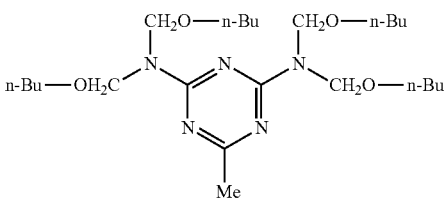

-continued (A)-4

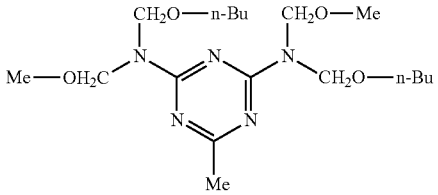

(A)-5

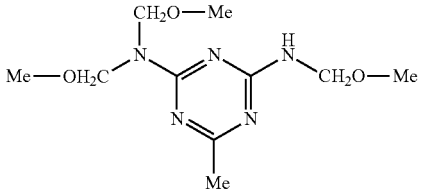

(A)-6

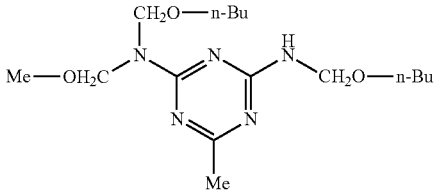

(A)-7

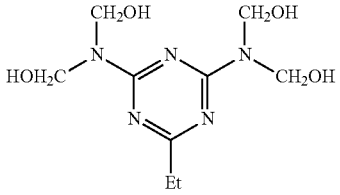

(A)-8

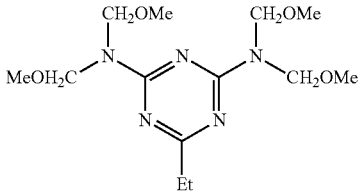

(A)-9

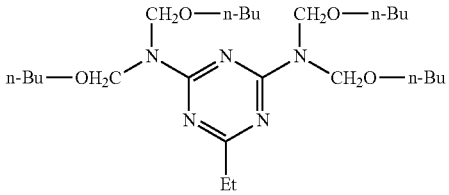

(A)-10

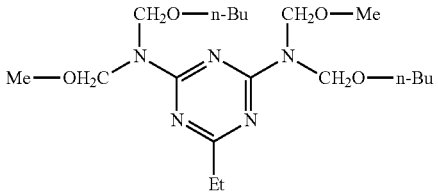

(A)-11

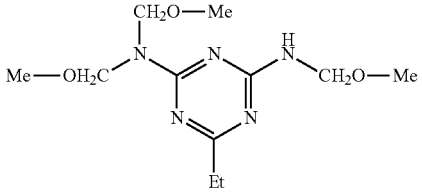

-continued
(A)-12
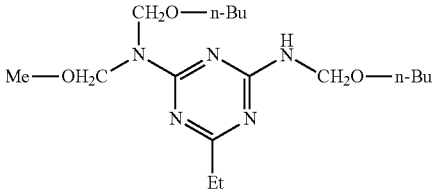
(A)-13
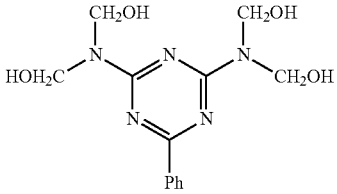
(A)-14
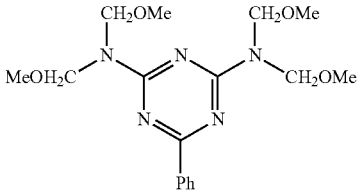
(A)-15
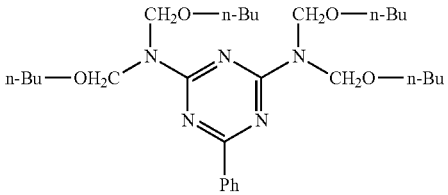
(A)-16
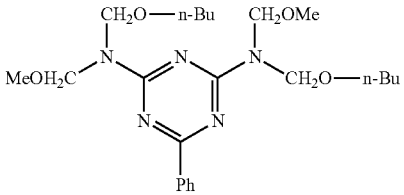
(A)-17
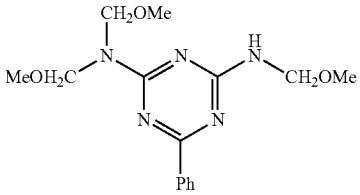
(A)-18
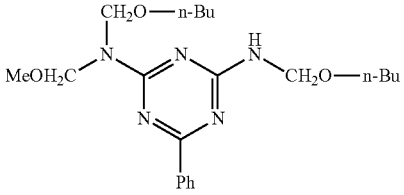
-continued
(A)-19
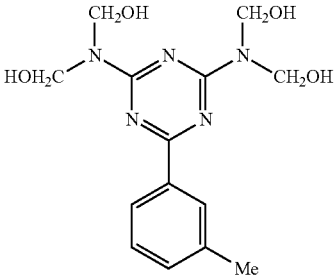
(A)-20
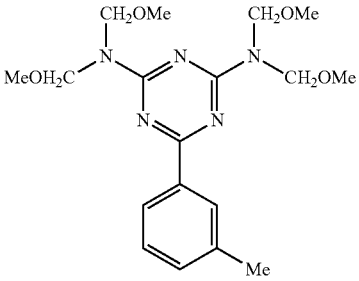
(A)-21
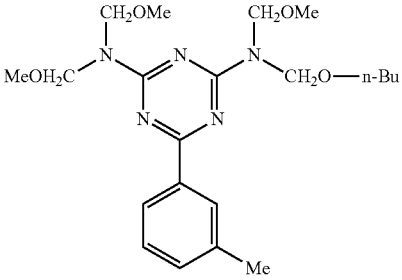
(A)-22
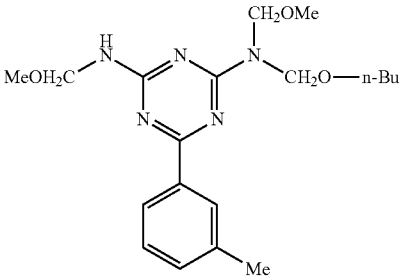
(A)-23
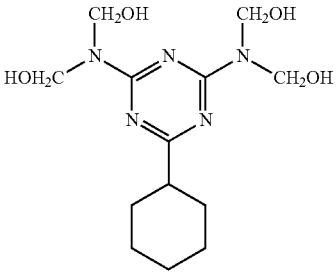

-continued
(A)-24
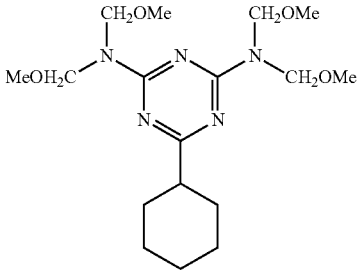
(A)-25
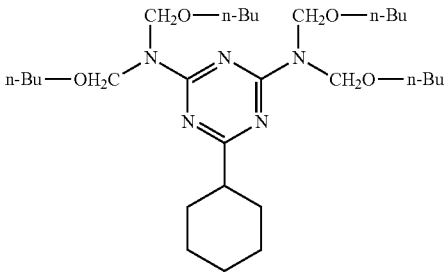
(A)-26
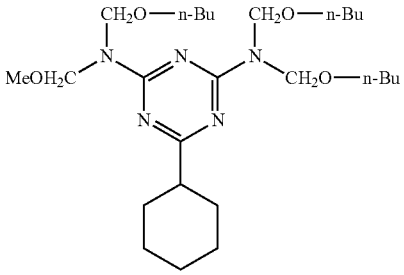
(A)-27
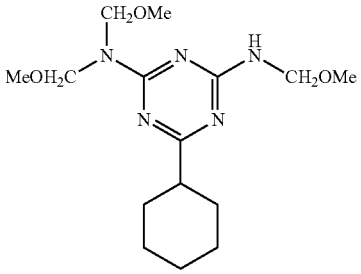
(A)-28
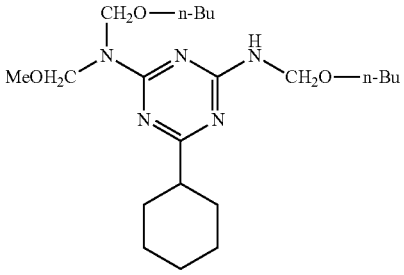
-continued
(A)-29
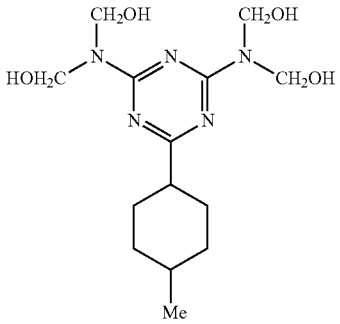
(A)-30
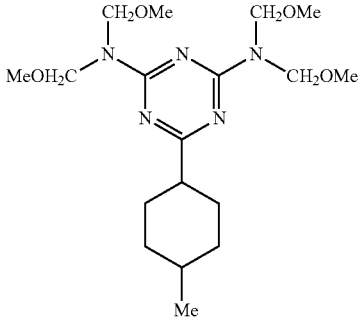
(A)-31
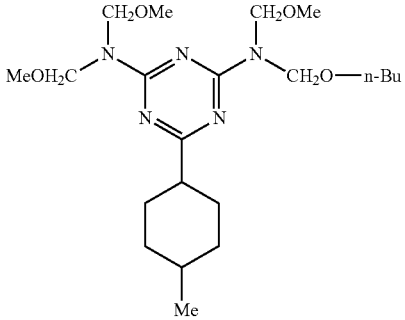
(A)-32
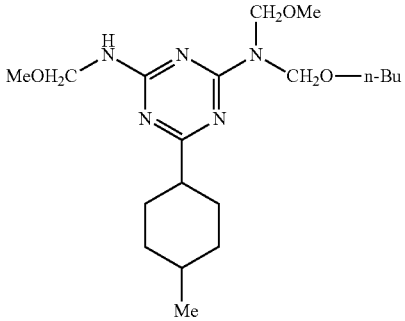
(A)-33
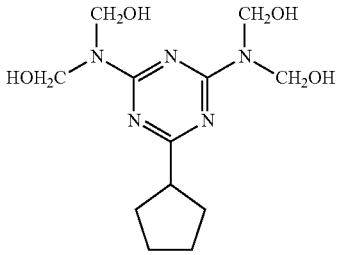

-continued (A)-34

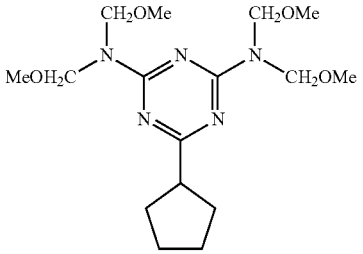

(A)-35

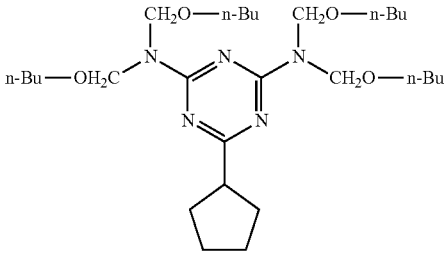

(A)-36

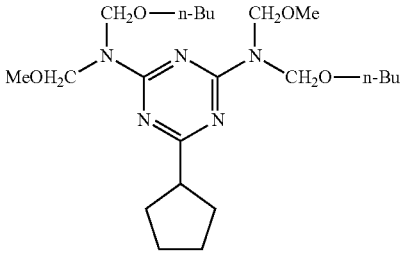

(A)-37

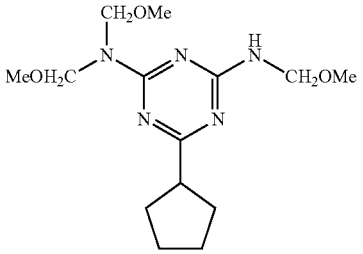

(A)-38

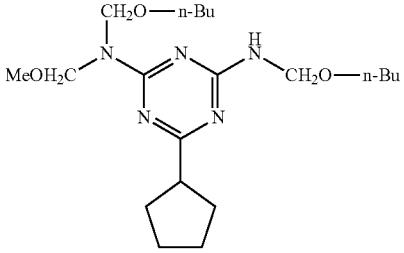

(A)-39

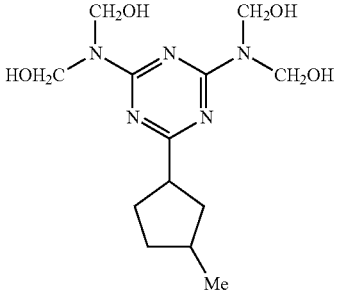

-continued (A)-40

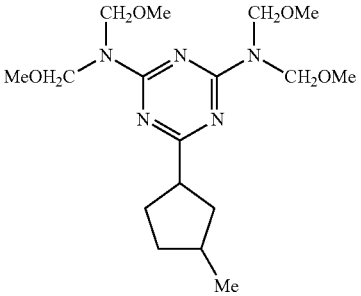

(A)-41

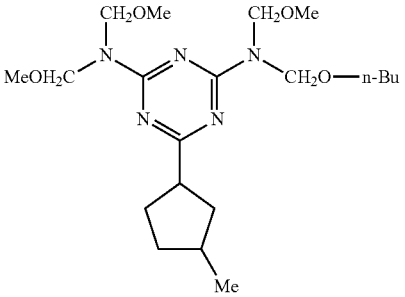

(A)-42

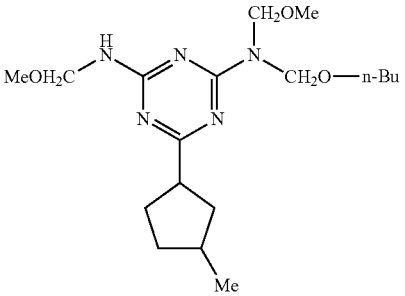

Examples of the commercially available compound represented by the formula (A) include SUPER BECKAMINE (R) L-148-55, SUPER BECKAMINE (R) 13-535, SUPER BECKAMINE (R) L-145-60, and SUPER BECKAMINE (R) TD-126 (all of which are manufactured by DIC Corporation), and NIKALAC BL-60, and NIKALAC BX-4000 (both of which are manufactured by Nippon Carbide Industries Co., Inc.).

The compounds (including oligomers) represented by the formula (A) may be dissolved in an appropriate solvent such as toluene, xylene or ethyl acetate, and washed with distilled water or ion-exchanged water, or may be treated with an ion-exchange resin, after the synthesis or the purchase of the commercially available product, in order to remove the influence of a residual catalyst.

Next, the description will be made of the melamine compound.

The melamine compound is a compound having a melamine skeleton (structure), and the melamine compound may be at least one of a compound represented by the following formula (B) or an oligomer thereof. Here, the oligomer is an oligomer in which the compound represented by the formula (B) is polymerized as a structural unit in the same manner as described above for the formula (A). The polymerization degree thereof is from 2 to 200 (or from 2 to 100), for example. The compound represented by the formula (B) or oligomer thereof may be used alone or may be used in combination of two or more kinds. The compound represented by the formula (B) or oligomer thereof may be used in combination with the compound represented by the formula (A) or oligomer thereof. In particular, when the compound represented by the formula (B) is used in combination of two or more kinds, or when the oligomer having the compound as its structural unit is used, it is possible to enhance the solubility in the solvent.

(B)

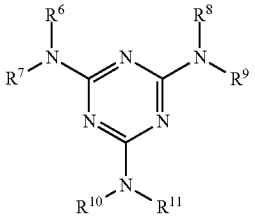

In the formula (B), $R^6$ to $R^{11}$ each independently represent a hydrogen atom, —$CH_2$—OH, —$CH_2$—O—$R^{12}$, and $R^{12}$ and $R^{12'}$ each independently represent an alkyl group that has from 1 to 5 carbon atoms and may be branched. Examples of the alkyl group include a methyl group, an ethyl group, and a butyl group.

The compound represented by the formula (B) is synthesized in a known method using, for example, melamine and formaldehyde (for example, the compound is synthesized in the same manner as the melamine resin described in The Fourth Series of Experimental Chemistry, Vol. 28, pp. 430).

Hereinafter, exemplified compounds (B)-1 to (B)-8 will be shown as the specific examples of the compound represented by the formula (B). However, the exemplary embodiment is not limited to these specific examples. In addition, although a monomer will be shown in each of the following specific examples, the compound may be an oligomer having the monomer as a structural unit.

(B)-1

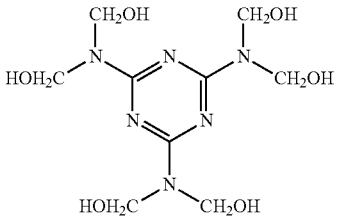

(B)-2

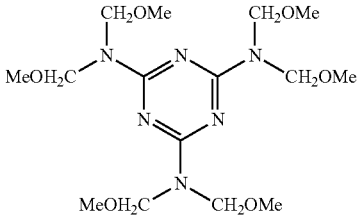

(B)-3

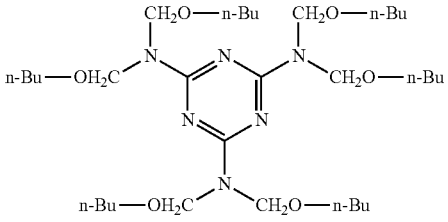

-continued (B)-4

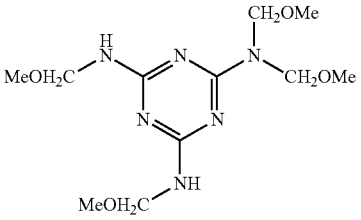

(B)-5

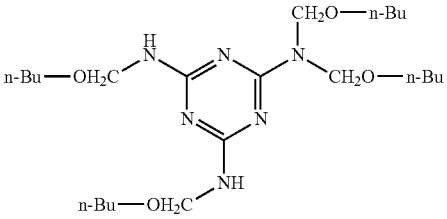

(B)-6

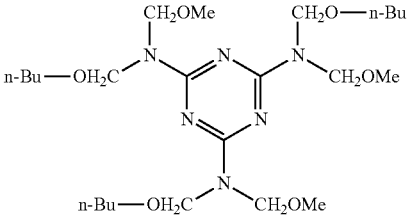

(B)-7

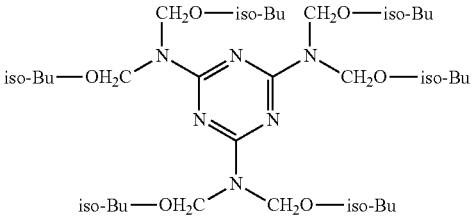

(B)-8

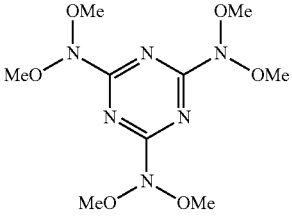

Examples of commercially available compound represented by the formula (B) include SUPER MELAMI No. 90 (manufactured by NOF Corporation), SUPER BECKAMINE (R) TD-139-60 (manufactured by DIC Corporation), U-VAN 2020 (manufactured by Mitsui Chemicals, Inc.), SUMITEX RESIN M-3 (manufactured by Sumitomo Chemical Co., Ltd.), and NIKALAC MW-30 (manufactured by Nippon Carbide Industries Co., Inc.).

In addition, the compounds (including oligomers) represented by the formula (B) may be dissolved in an appropriate solvent such as toluene, xylene or ethyl acetate, and washed with distilled water or ion-exchanged water, or may be treated with an ion-exchange resin, after the synthesis or the purchase of the commercially available product, in order to remove the influence of a residual catalyst.

Next, the description will be made of the specific charge-transporting material. Examples of the specific charge-transporting material include one having at least one substituent selected from —OH, —$OCH_3$, —$NH_2$, —SH, and —COOH.

Particular examples of the specific charge-transporting material include one having at least two (or three) substituents selected from —OH, —$OCH_3$, —$NH_2$, —SH, and —COOH. A high cross-linking density is obtained by increasing the reactive functional groups (the substituents as described above) in the specific charge-transporting material as described above, and a cross-linked film with a higher strength is obtained. In addition, the rotational torque of the electrophotographic photoreceptor is reduced particularly when a foreign matter removing member such as a blade member is used, and the abrasions of the foreign matter removing member and the electrophotographic photoreceptor are suppressed. Although the detailed reason has not been clarified, it is presumed that these facts occur because a cured layer with a high cross-linking density is obtained by increasing the number of the reactive functional groups, the molecule movement on the surface of the electrophotographic photoreceptor is suppressed, and thereby the interaction with the surface molecules of the blade member and the carrier is weakened.

The specific charge-transporting material may be a compound represented by the following formula (I) from the viewpoint of suppressing the abrasion of a foreign matter removing member or the abrasion of the electrophotographic photoreceptor.

$$F(—(R^{13}—X)_{n1}—(R^{14})_{n2}—Y)_{n3} \quad (I)$$

In the formula (I), F represents an organic group derived from a compound having a hole-transporting ability, $R^{13}$ and $R^{14}$ each independently represent a linear or branched alkylene group having from 1 to 5 carbon atoms, n1 represents 0 or 1, n2 represents 0 or 1, and n3 represents an integer from 1 to 4. X represents an oxygen atom, NH, or a sulfur atom, and Y represents —OH, —$OCH_3$, —$NH_2$, —SH, or —COOH.

In the formula (I), examples of the compound having a hole-transporting ability in the organic group derived from the compound having a hole-transporting ability represented by F include an arylamine derivative. Examples of the arylamine derivative include a triphenylamine derivative and a tetraphenylbenzidine derivative.

The compound represented by the formula (I) may be the compound represented by the following formula (II). The compound represented by the formula (II) is excellent particularly in charge mobility, stability with respect to oxidization, and the like.

(II)

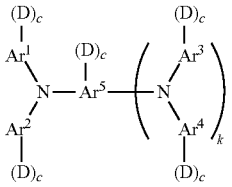

In the formula (II), $Ar^1$ to $Ar^4$ may be the same or different from each other and each independently represent a substituted or unsubstituted aryl group, $Ar^5$ represents a substituted or unsubstituted aryl group or a substituted or unsubstituted arylene group, D represents —$(R^{13}—X)_{n1}—(R^{14})_{n2}$—Y, each c independently represents 0 or 1, k represents 0 or 1, and the total number of D is from 1 to 4. In addition, $R^{13}$ and $R^{14}$ each independently represent a linear or branched alkylene group having from 1 to 5 carbon atoms, n1 represents 0 or 1, n2 represents 0 or 1, X represents an oxygen atom, NH, or a sulfur atom, and Y represents —OH, —$OCH_3$, —$NH_2$, —SH, or —COOH.

In the formula (II), "—$(R^{13}—X)_{n1}—(R^{14})_{n2}$—Y" represented by D is the same as that in the formula (I), and $R^{13}$ and $R^{14}$ each independently represent a linear or branched alkylene group having from 1 to 5 carbon atoms. In addition, n1 may be 1, and n2 may be 1. X may be an oxygen atom, and Y may be a hydroxyl group.

In addition, the total number of D in the formula (II) corresponds to n3 in the formula (I), and may be from 2 to 4, or from 3 to 4.

Moreover, when the total number of D in a molecule is from 2 to 4 in the formulae (I) and (II), the cross-linking density is enhanced, and thereby a cross-linked film with a higher strength is obtained. In particular, the rotational torque of the electrophotographic photoreceptor is reduced when a blade member for removing foreign matter is used, and the abrasions of the blade member and the electrophotographic photoreceptor are suppressed. Although the detail thereof has not been clarified, it is presumed that these facts occur because a cured layer with a high cross-linking density is obtained by increasing the number of the reactive functional groups, the molecule movement on the surface of the electrophotographic photoreceptor is suppressed, and thereby the interaction with the surface molecules of the blade member and the carrier is weakened.

In the formula (II), each of $Ar^1$ to $Ar^4$ may be any one of the following formulae (1) to (7). In addition, the following formulae (1) to (7) will be shown with "-$(D)_C$" which may be linked to each of $Ar^1$ to $Ar^4$.

(1)

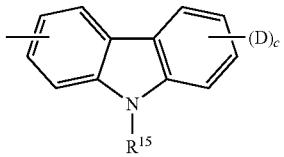

(2)

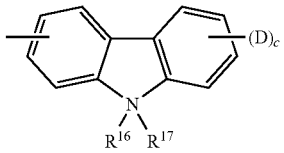

(3)

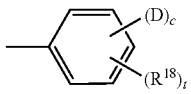

(4)

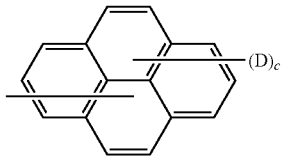

(5)

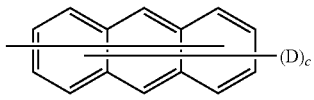

(6)

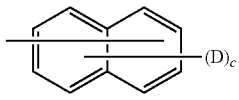

-continued (7)

$$-Ar-(Z')_s-Ar-(D)_c$$

In the formulae (1) to (7), $R^{15}$ represents one selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, an aralkyl group having from 7 to 10 carbon atoms, $R^{16}$ to $R^{17}$ each independently represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, each $R^{18}$ independently represents one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, Ar represents a substituted or unsubstituted arylene group, D and c are the same as "D" and "c" in the formula (II), s represents 0 or 1, and t represents an integer from 1 to 3.

Here, Ar in the formula (7) may be the one represented by the following formula (8) or (9).

(8)

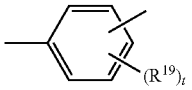

(9)

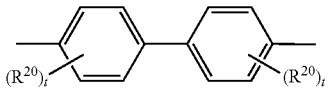

In the formulae (8) and (9), $R^{19}$ and $R^{20}$ each independently represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, and t represents an integer from 1 to 3.

In addition, Z' in the formula (7) may be the one represented by any one of the following formulae (10) to (17).

(10) $-(CH_2)_q-$

(11) $-(CH_2CH_2O)_r-$ (12)

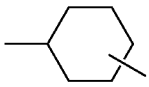

(13)

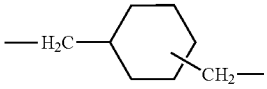

-continued (14)

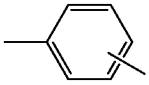

(15)

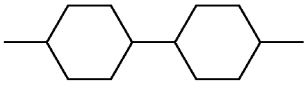

(16)

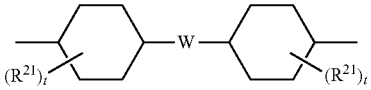

(17)

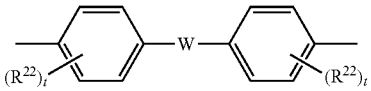

In the formulae (10) to (17), $R^{21}$ and $R^{22}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, W represents a divalent group, q and r each represent an integer from 1 to 10, and each t represents an integer from 1 to 3.

In addition, W in the formulae (16) and (17) may be any one of the divalent groups represented by the following formulae (18) to (26). However, in the formula (25), u represents an integer from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

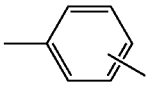

(25)

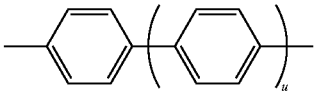

(26)

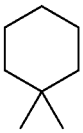

In addition, in the formula (II), $Ar^5$ may represent an aryl group of the above (1) to (7) shown in the description for $Ar^1$ to $Ar^4$ when k is 0, and an arylene group obtained by removing a hydrogen atom from an aryl group of the above (1) to (7) when k is 1.

Specific examples of the compound represented by the formula (I) include the compounds shown below. In addition, the compound represented by the above formula (I) is not limited to these specific examples.
I-1
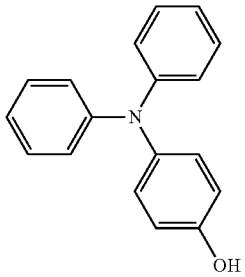
I-2
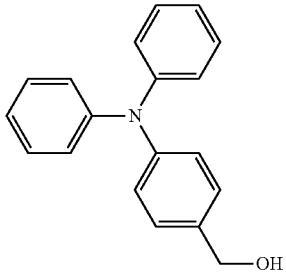
I-3
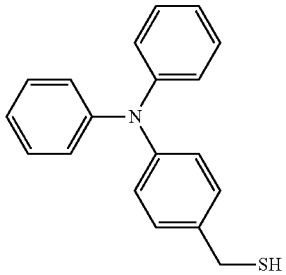
I-4
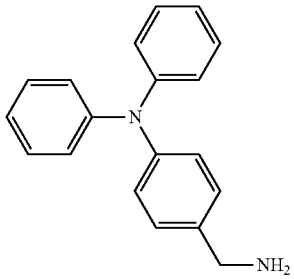
I-5
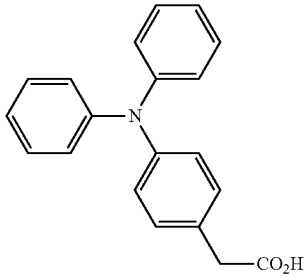
-continued
I-6
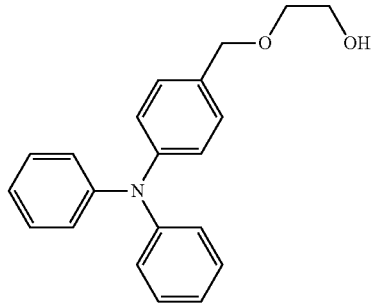
I-7
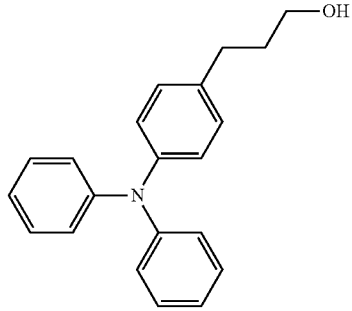
I-8
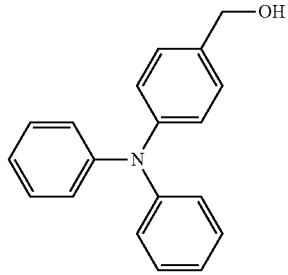
I-9
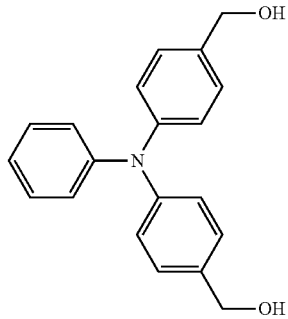
I-10
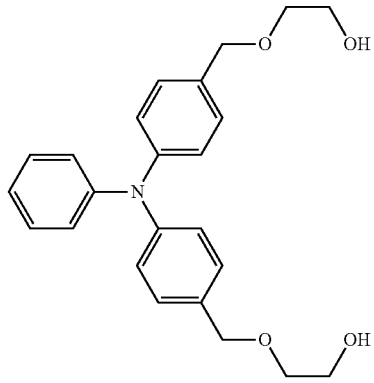

-continued
I-11
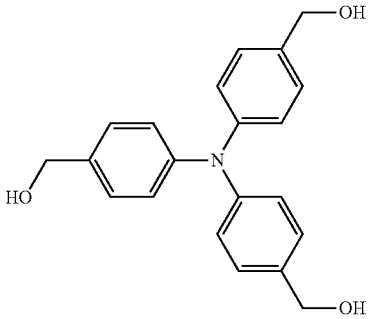
I-12
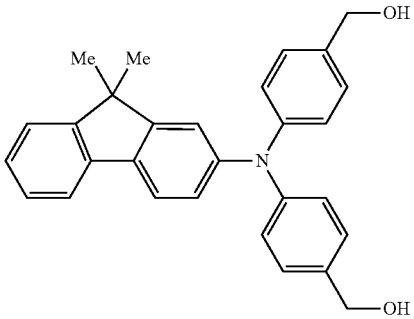
I-13
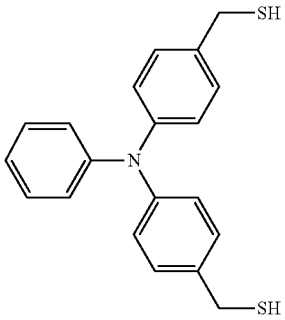
I-14
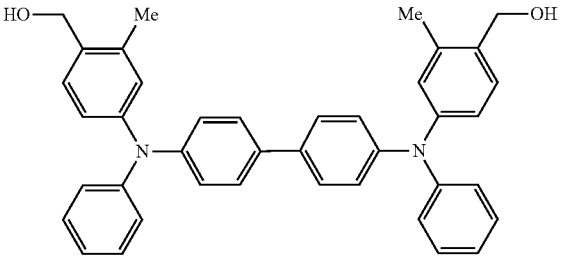
I-15
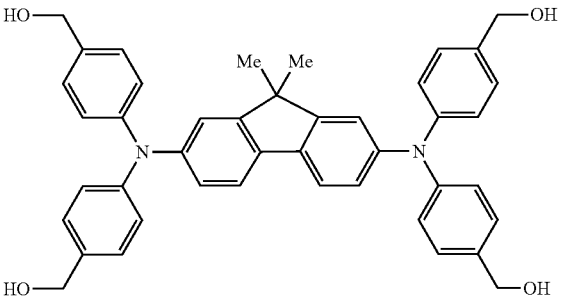
-continued
I-16
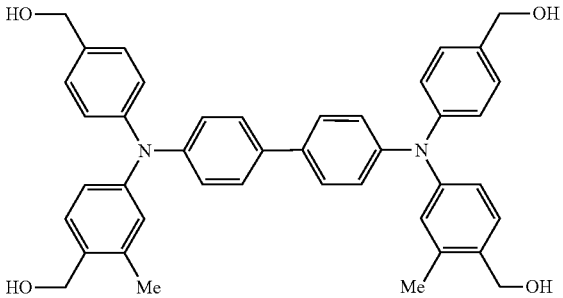
I-17
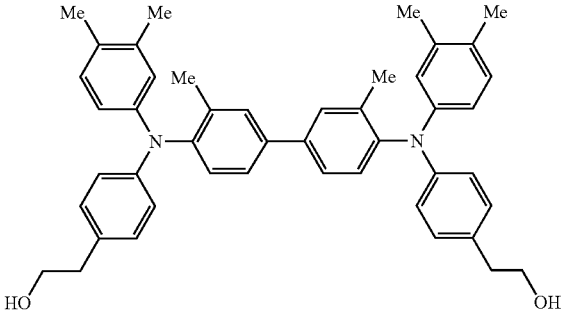
I-18
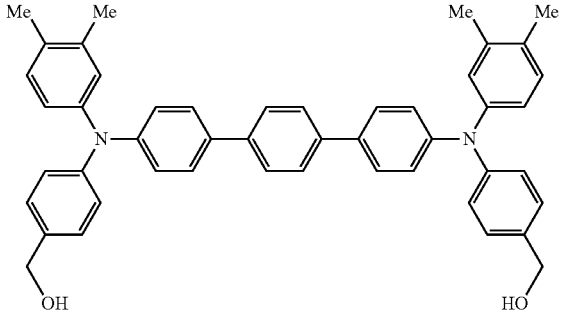
I-19
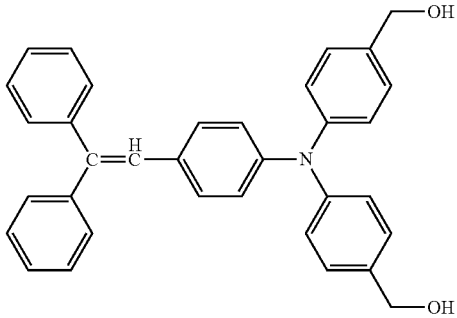
I-20
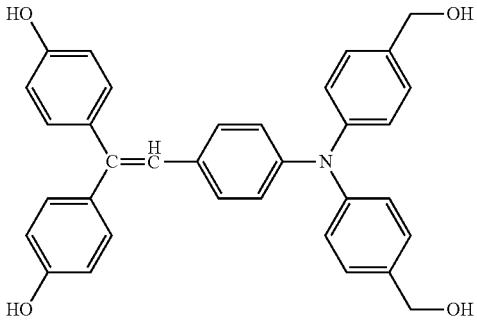

-continued
I-21
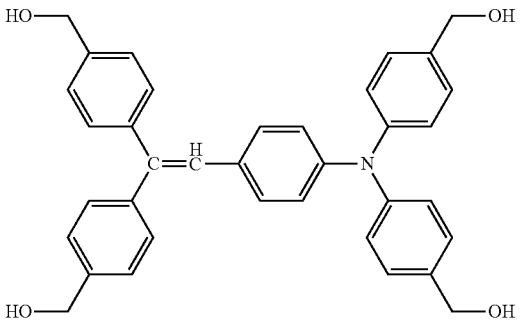
I-22
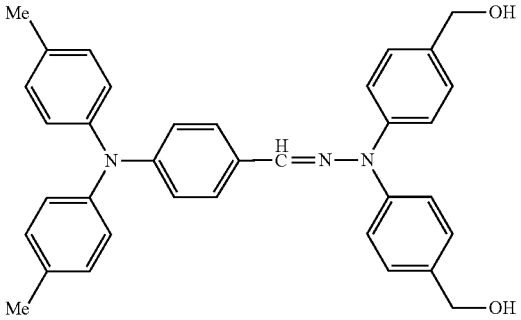
I-23
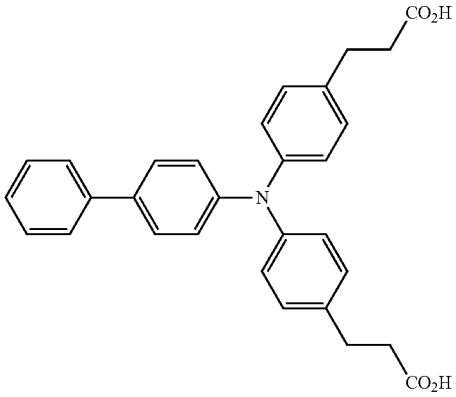
I-24
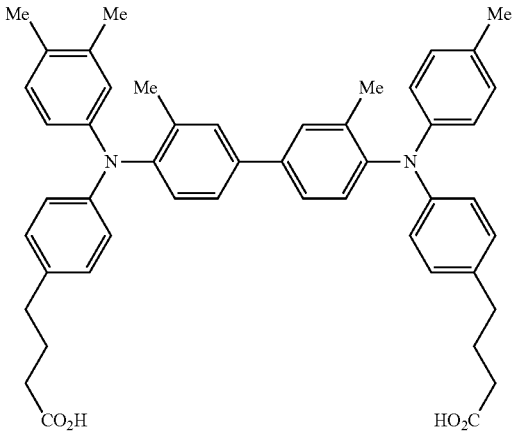
-continued
I-25
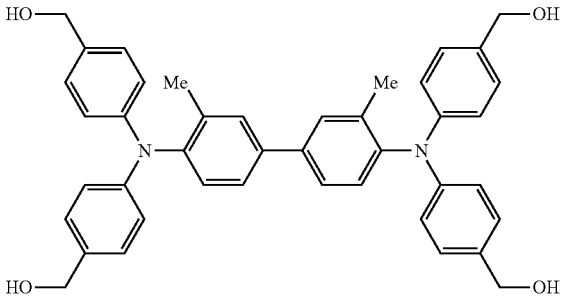
I-26
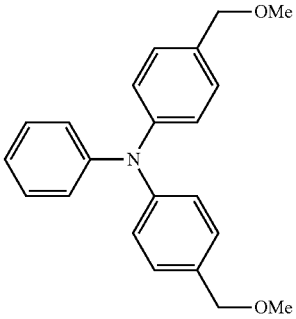
I-27
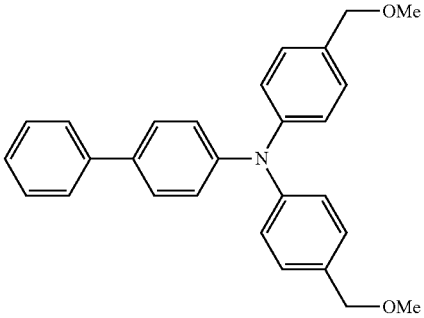
I-28
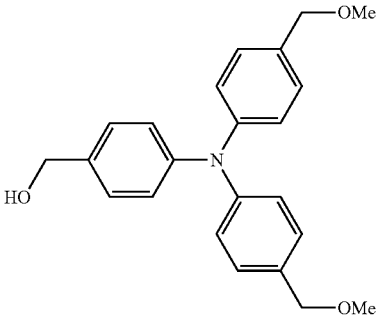
I-29
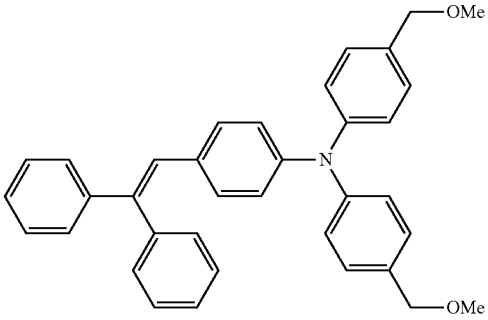

-continued

I-30

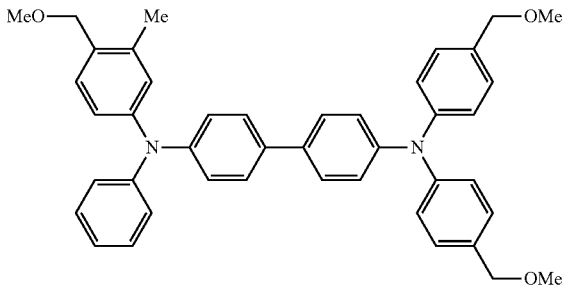

I-31

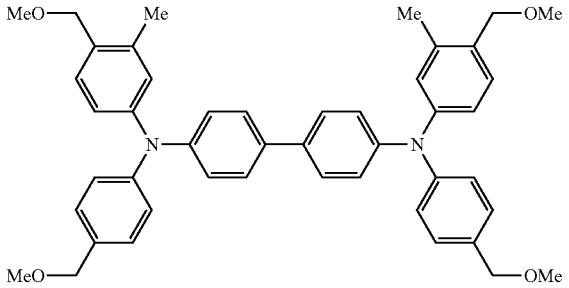

Here, the content (content in the solid components of the coating liquid) of the at least one compound selected from the group consisting of guanamine compounds (the compound represented by the formula (A)) and melamine compounds (the compound represented by the formula (B)) may be from 0.1% by weight (or about 0.1% by weight) to 5% by weight (or about 5% by weight), or from 1% by weight (or about 1% by weight) to 3% by weight (or about 3% by weight). When this content is less than 0.1% by weight, it may be difficult to achieve a satisfactory strength since a dense film may not be formed. When this content is over 5% by weight, the electric properties and the resistance to ghosts (irregularities in the density due to the image history) may be degraded in some cases.

Meanwhile, the content of the at least one specific charge-transporting material (content in the solid components of the coating liquid) may be 90% by weight or more, or 94% by weight or more. When this content is less than 90% by weight, there is a fear that the electric properties are degraded. In addition, the upper limit of this content is not limited as long as the at least one compound selected from guanamine compounds (the compound represented by the formula (A)) and melamine compounds (the compound represented by the formula (B)) and other additives effectively function, and the upper limit may be as high as possible.

Hereinafter, the overcoat layer will be further described in detail.

In the overcoat layer, a phenol resin, a urea resin, an alkyd resin, or the like may be used together with the cross-linked material of the at least one compound selected from guanamine compounds (the compound represented by the formula (A)) and melamine compounds (the compound represented by the formula (B)) and the specific charge-transporting material (the compound represented by the formula (I)). In addition, it is effective that a compound with more functional groups in a molecule such as a spiroacetal-based guanamine resin (for example, "CTU-GUANAMINE" manufactured by Ajinomoto Fine-Techno Co., Inc.) is copolymerized with materials within the cross-linked material in order to enhance the strength.

In addition, in the overcoat layer, another thermosetting resin may be used such as a phenol resin in order to effectively suppress the oxidation due to the discharge product gas by preventing excessive adsorption of the discharge product gas.

In addition, a surfactant may be added to the overcoat layer. The surfactant to be used is not particularly limited as long as the surfactant has at least one structure selected from a fluorine atom, an alkylene oxide structure, and a silicone structure. A surfactant having plural structures described above may be used since such a surfactant may exhibit a high affinity and compatibility with the charge-transporting organic compound, enhance the film formability of the coating liquid for the overcoat layer, and suppress the wrinkles and irregularities in the overcoat layer.

In addition, a coupling agent and a fluorine compound may be used in the overcoat layer in order to adjust the film formability, the flexibility, the lubricating property, and the adhesiveness of the film. As such a compound, various silane coupling agents and commercially available silicone-based hard coating agents are used.

In addition, a resin which is dissolved in alcohol may be added in order to enhance the discharge gas resistance of the overcoat layer, the mechanical strength, the scratch resistance, and the particle dispersion property, control the viscosity and abrasion amount, reduce the torque, and extend the pot life, for example.

Here, a resin which is dissolved in alcohol means a resin which is dissolved in alcohol having 5 or less carbon atoms in an amount of 1% by weight or more. Examples of the resin which is soluble in an alcohol-based solvent include polyvinyl acetal resin and polyvinyl phenol resin.

An antioxidant may be added to the overcoat layer in order to prevent the overcoat layer from deteriorating due to oxidized gas such as ozone generated in the charging device. When the mechanical strength of the surface of the photoreceptor is strengthened, and thereby the lifespan of the photoreceptor is elongated, since the photoreceptor is in contact with oxidized gas for a longer time, the oxidization resistance is required to be stronger as compared with the conventional photoreceptor. As the antioxidant, hindered phenol-based antioxidant or hindered amine-based antioxidant may be used, and a known antioxidant such as an organic sulfur-based antioxidant, a phosphate-based antioxidant, a dithiocarbamate-based antioxidant, a thiourea-based antioxidant, or a benzimidazole-based antioxidant may be used. The addition amount of the antioxidant may be 20% by weight or less, or 10% by weight or less.

Furthermore, various particles may be added to the overcoat layer in order to decrease the residual potential or enhance the strength. Examples of the particles include particles containing silicon. Particles containing silicon are particles containing silicon as a constituent element. Specifically, examples of the particles containing silicon include colloidal silica, and silicone particles.

In addition, oil such as silicone oil may be added for the same purpose.

Moreover, metal, metal oxide, or carbon black, for example, may be added to the overcoat layer.

The overcoat layer may be a cured layer obtained by curing at least one compound selected from guanamine compounds and melamine compounds and at least one specific charge-transporting material using an acid catalyst. As the acid catalyst, aliphatic carboxylic acid such as acetic acid, chloroacetic acid, trichloroacetic acid, trifluoroacetic acid, oxalic acid, maleic acid, malonic acid, or lactic acid, aromatic carboxylic acid such as benzoic acid, phthalic acid, terephthalic acid, or trimellitic acid, aliphatic or aromatic sulfonic acids such as methane sulfonic acid, dodecyl sulfonic acid, benzenesulfonic acid, dodecylbenzenesulfonic acid, or naphthalenesulfonic acid is used. However, a sulfur containing material may be used.

Here, the addition amount of the catalyst may be in a range from 0.1% by weight to 50% by weight or in a range from 10% by weight to 30% by weight with respect to the amount of the at least one compound selected from guanamine compounds (the compound represented by the formula (A)) and melamine compounds (the compound represented by the formula (B)) (the content in the solid components of the coating liquid). When the amount is less than the above ranges, the catalyst activity is excessively lowered in some cases. When the amount is over the above ranges, the light resistance is degraded in some cases. The light resistance relates to a phenomenon in which a photosensitive layer is exposed by external light such as room light, and the decrease in the density occurs in the irradiated portion. Although what causes this phenomenon has not been clarified, it is presumed that this phenomenon occurs because the same phenomenon as an optical memory effect occurs as disclosed in JP-A A No. 5-099737.

The overcoat layer with the above configuration is formed using a coating liquid forming the overcoat layer obtained by mixing the above components. The coating liquid for forming the overcoat layer may be prepared without a solvent or with a solvent, if necessary. Such a solvent is used alone or in combination of two or more kinds, and may be the one with a boiling point of 100° C. or less. As the solvent, a solvent having at least one hydroxyl group (for example, alcohols) may be used in particular.

When the coating liquid is obtained by causing the above components to react, the above components may be simply mixed and dissolved. However, the components may be heated at a temperature from a room temperature (25° C., for example) to 100° C., or from 30° C. to 80° C. for a time period from 10 minutes to 100 hours or from 1 hour to 50 hours. In addition, the components may be irradiated with an ultrasonic wave at this time. It is possible to more easily obtain a film with less film coating defects and less thickness irregularities probably because a partial reaction is made to proceed by the irradiation of the ultrasonic wave.

In addition, it is possible to obtain the overcoat layer by coating with the coating liquid for forming the overcoat layer in a known method such as a blade-coating method, a wire bar coating method, a spray coating method, a dip-coating method, a bead coating method, an air knife coating method, or a curtain coating method, and heating at a temperature, for example, from 100° C. to 170° C., if necessary, to cause the coaling liquid to cure.

In the electrophotographic photoreceptor according to the exemplary embodiment, the thickness of the photosensitive layer constituted by the charge-generating layer and the charge-transporting layer may be from 18 μm to 23 μm, and the thickness of the overcoat layer may be from 5 μm to 10 μm.

(Image Forming Apparatus/Process Cartridge)

Figure 2:
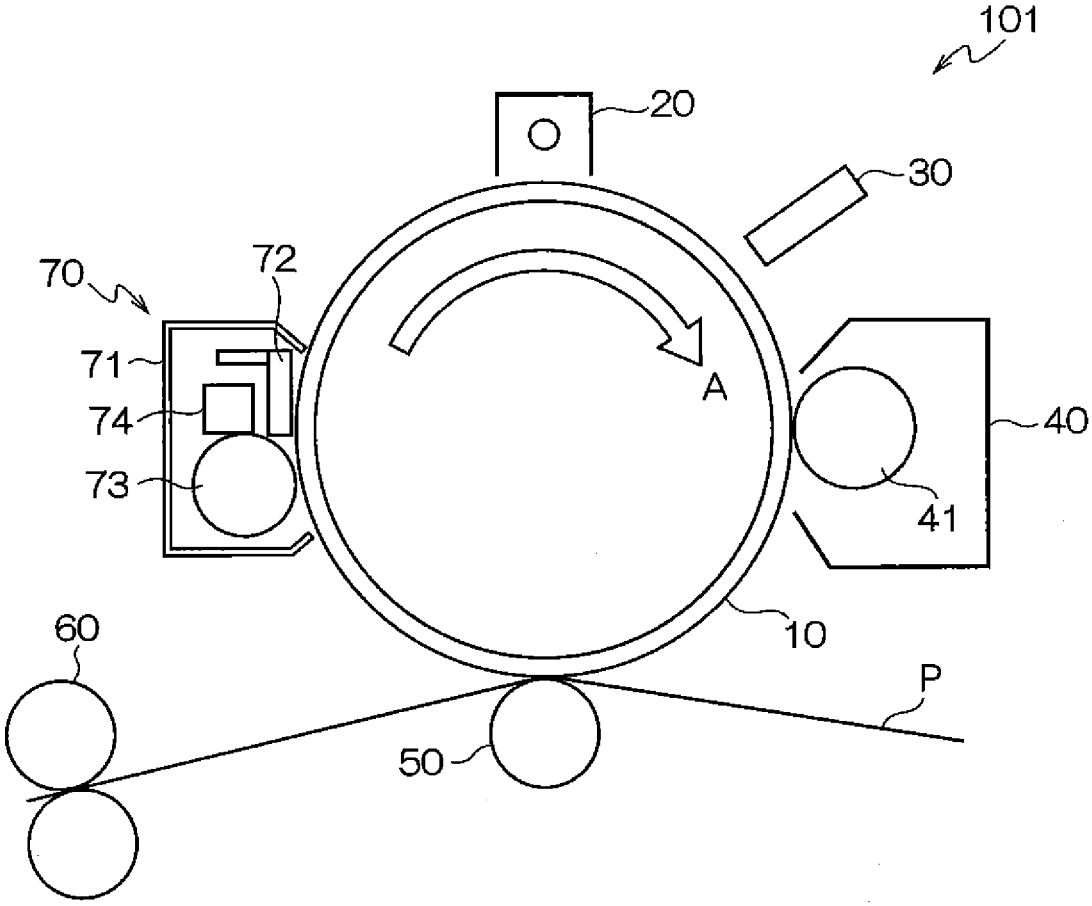
FIG. 2 is a schematic configuration diagram illustrating an image forming apparatus according to an exemplary embodiment.

FIG. 2 is a schematic configuration diagram illustrating an image forming apparatus according to the exemplary embodiment.

As shown in FIG. 2, an image forming apparatus 101 according to the exemplary embodiment includes, for example, an electrophotographic photoreceptor 10 which rotates in a clockwise direction as shown by an arrow A, a charging device 20 (an example of charging unit) which is provided over the electrophotographic photoreceptor 10 while facing the electrophotographic photoreceptor 10 and charges the surface of the electrophotographic photoreceptor 10, an exposure device 30 (an example of electrostatic latent image forming unit) which exposes the surface of the electrophotographic receptor 10 charged by the charging device 20 to form an electrostatic latent image, a developing device 40 (an example of developing unit) which causes the toner contained in a developing agent to adhere to the electrostatic latent image formed by the exposure device 30 to form a toner image on the surface of the electrophotographic photoreceptor 10, a transferring device 50 which causes recording paper P (transfer medium) to be charged with a polarity different from the charge polarity of the toner to transfer the toner image on the electrophotographic receptor 10 to the recording paper P, and a cleaning device 70 (an example of toner removing unit) for cleaning the surface of the electrophotographic photoreceptor 10. In addition, a fixing device 60 is provided for fixing the toner image while transporting the recording paper P with the toner image formed thereon.

Hereinafter, the detailed description will be made of the main constituent members in the image forming apparatus 101 according to the exemplary embodiment.

—Charging Device—

Examples of the charging device 20 include a contact type charger using a conductive charge roller, a charge brush, a charge film, a charge rubber blade, or a charge tube, for example. In addition, examples of the charging device 20 also include, for example, a charger, which has been already known, such as a non-contact type roller charger, a scorotron charger using corona discharge, or a corotron charger. A contact type charger may be used as the charging device 20.

—Exposure Device—

Examples of the exposure device 30 include optical equipment, for example, for exposing the surface of the electrophotographic photoreceptor 10 with semiconductor laser light, LED light beam, or liquid crystal shutter light, for example, in the form of an image. The wavelength of the light source may be in the spectral sensitivity region of the electrophotographic photoreceptor 10. As for the wavelength of the semiconductor laser, a near-infrared laser having an oscillation wavelength near 780 nm may be used. However, the wavelength is not limited thereto, and a laser having an oscillation wavelength of from 600 nm to less than 700 nm or a laser having an oscillation wavelength from 400 nm to 450 nm as a blue laser may also be used. In addition, as the exposure device 30, it is also effective to use a surface-emitting laser light source which outputs multi beams in order to form a color image.

—Developing Device—

Examples of the configuration of the developing device 40 include one in which a developing roll 41 arranged in the developing region so as to face the electrophotographic photoreceptor 10 is provided in a container for containing a two-component developer including a toner and a carrier, for example. The developing device 40 is not particularly limited as long as the device performs the development with a two-component developer, and a known configuration is adopted.

Here, the description will be made of a developer used for the developing device 40.

As the developer, a two-component developer including a toner and a carrier is adopted.

First, the description will be made of a toner.

The toner may include toner particles containing a binder resin, a colorant, and if necessary, other additives such as a release agent, and if necessary, an external additive.

The average shape factor of the toner particles (a number average of the shape factor represented by the formula: shape factor=$(ML^2/A)\times(\pi/4)\times100$, where ML represents a maximum length of the particle and A represents a projected area of the particle) may be from 100 to 150, from 105 to 145, or from 110 to 140. In addition, a volume-average particle diameter of the toner may be from 3 μm to 12 μm, from 3.5 μm to 10 μm, or from 4 μm to 9 μm.

Although the production method of the toner particles is not particularly limited, the toner particles may be produced, for example, by a kneading and pulverizing method in which a binder resin, a colorant, a release agent, and if necessary, a charge control agent, for example, are added, and the resultant mixture is kneaded, pulverized and classified; a method in which the shapes of the particles obtained by the kneading and pulverizing method are changed by a mechanical impact force or a thermal energy; an emulsion polymerization and aggregation method in which an emulsion polymerization of polymerizable monomers of a binder resin is caused, the thus formed dispersion liquid and a dispersion liquid of a colorant, a release agent, and if necessary, a charge control agent, for example, are mixed, aggregated, and heat-melted to obtain the toner particles; a suspension polymerization method in which polymerizable monomers to obtain a binder resin, a colorant, a release agent, and if necessary, a charge control agent, for example, are suspended and polymerized in an aqueous solvent; and a dissolution suspension method in which a binder resin, a colorant, a release agent, and if necessary a charge control agent, for example, are suspended in an aqueous solvent to granulate the toner particles.

In addition, a known method such as a production method for causing the particles to have a core shell structure by further making aggregated particles adhere to the toner particles, which have been obtained by one of the above methods, as cores and thermally fusing the resultant mixture is employed. In addition, the suspension polymerization method for producing the toner using an aqueous solvent, the emulsion polymerization and aggregation method, and the dissolution suspension method may be used, and the emulsion polymerization and aggregation method may be used, from the viewpoint of controlling the shapes and the particle size distribution.

Then, the toner is produced by mixing the above toner particles and the above external additive using a Henschel mixer, or a V-blender, for example. In addition, when the toner particles are produced in a wet manner, the external additive may be externally added in a wet manner.

In addition, when the toner is used as a two-component developer, the mixing ratio of the toner particles to the carrier is set to be a known ratio. In addition, the carrier is not particularly limited. However, examples of the carrier include one obtained by coating the surfaces of magnetic particles with a resin.

—Transferring Device—

Examples of the transferring device 50 include a transferring charger, which is already known, such as a contact type transferring charger using a belt, a roller, a film, or a rubber blade, a scorotron transferring charger using corona discharge, and a corotron charger.

—Cleaning Device—

The cleaning device 70 includes, for example, a case body 71, a cleaning blade 72, and a cleaning brush 73 arranged at the downstream side of the cleaning blade 72 in the rotation direction of the electrophotographic photoreceptor 10. In addition, a solid-state lubricant agent 74 is arranged so as to contact with the cleaning brush 73.

Hereinafter, the description will be made of the operation of the image forming apparatus 101 according to the exemplary embodiment. First, the electrophotographic photoreceptor 10 is rotated along the direction represented by the arrow A and negatively charged by the charging device 20 at the same time.

The electrophotographic photoreceptor 10 of which the surface has been negatively charged by the charging device 20 is exposed by the exposure device 30, and an electrostatic latent image is formed on the surface thereof.

A part in the electrophotographic photoreceptor 10, in which the electrostatic latent image has been formed, approaches the developing device 40, and then a toner is adhered to the electrostatic latent image by the developing device 40 (the developing roll 41) to form a toner image.

The electrophotographic photoreceptor 10 with the toner image formed thereon is further rotated in the direction of the arrow A, and the toner image is then transferred to the recording paper P by the transferring device 50. As a result, the toner image is formed on the recording paper P.

In the recording paper P with an image formed thereon, the toner image is fixed by the fixing device 60.

Figure 3:
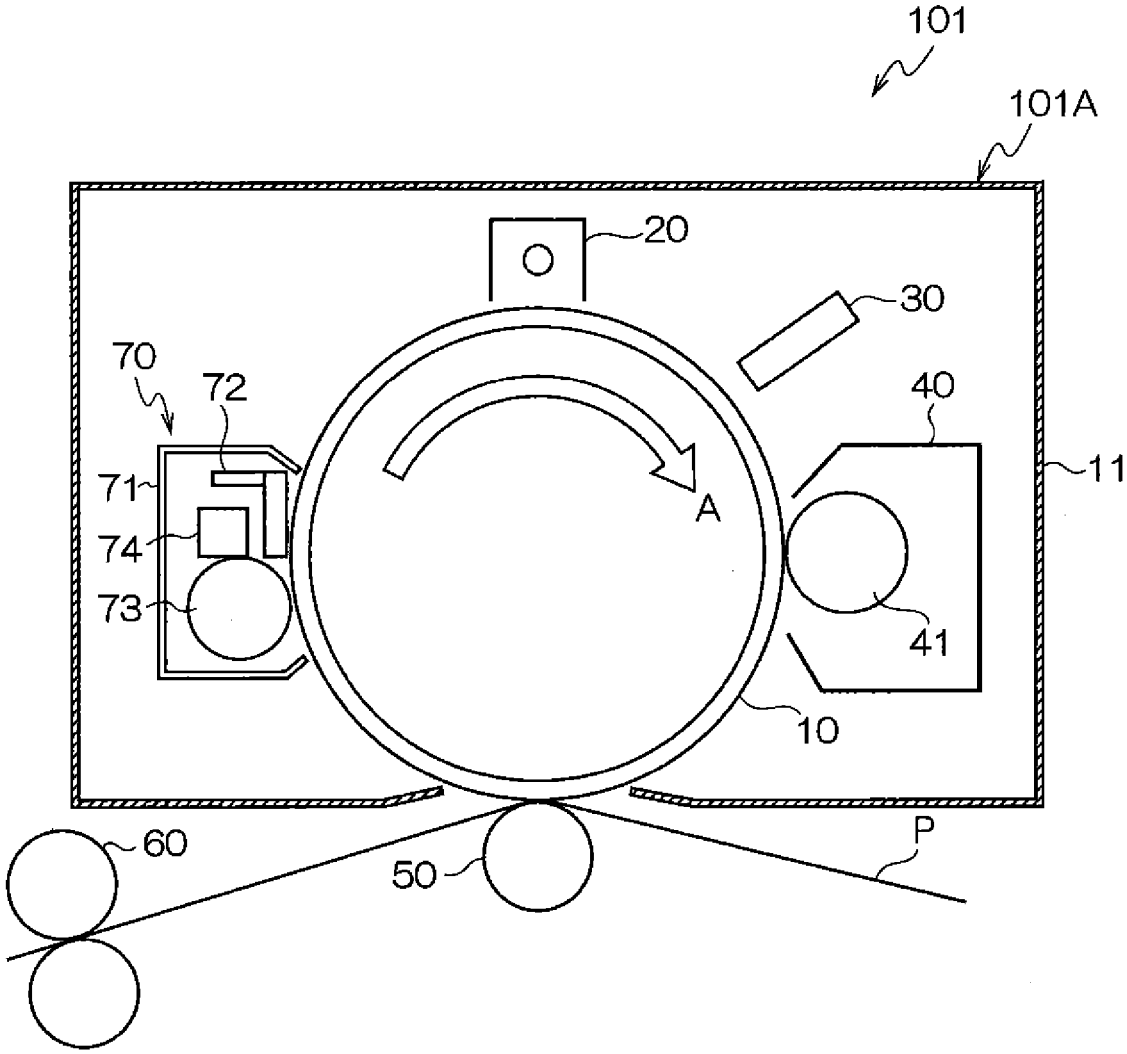
FIG. 3 is a schematic configuration diagram illustrating an image forming apparatus according to another exemplary embodiment.

The image forming apparatus 101 according to the exemplary embodiment may include, for example, a process cartridge 101A which integrally contains the electrophotographic photoreceptor 10, the charging device 20, the exposure device 30, the developing device 40, and the cleaning device 70 within the case body 11 as shown in FIG. 3. This process cartridge 101A integrally contains plural members and is attached to or detached from the image forming apparatus 101.

The configuration of the process cartridge 101A is not limited thereto. Any configuration is applicable as long as the process cartridge 101A is provided with at least the electrophotographic photoreceptor 10. For example, a configuration is also applicable in which the process cartridge 101A is provided with at least one selected from the charging device 20, the exposure device 30, the developing device 40, the transferring device 50, and the cleaning device 70.

The image forming apparatus 101 according to the exemplary embodiment is not limited to the above configuration. For example, the image forming apparatus 101 may include a first eraser, which aligns the polarities of the residual toners to easily remove the residual toners with the cleaning brush, and which is provided around the electrophotographic photoreceptor 10 at the downstream side of the transferring device 50 in the rotation direction of the electrophotographic photoreceptor 10 but at the upstream side of the cleaning device 70 in the rotation direction of the electrophotographic photoreceptor. The image forming apparatus 101 may also include a second eraser, which erases charges on the surface of the electrophotographic photoreceptor 10, and which is provided at the downstream side of the cleaning device 70 in the rotation direction of the electrophotographic photoreceptor but at the upstream side of the charging apparatus 20 in the rotation direction of the electrophotographic photoreceptor.

In addition, the image forming apparatus 101 according to the exemplary embodiment is not limited to the above configuration. A known configuration may be used such as an intermediate transfer type image forming apparatus for transferring a toner image onto the recording paper P after transferring the toner image formed on the electrophotographic photoreceptor 10 onto an intermediate transfer body or a tandem type image forming apparatus.

EXAMPLES

Hereinafter, the present invention will be further specifically described based on Examples and Comparative Examples. However, the present invention is not limited at all to the following Examples.

[Formation of Charge-Generating Layer]

(Charge-Generating Layer 1)

As the charge-generating material, a hydroxygallium phthalocyanine, which has a ionization potential of 5.31 eV and main diffraction peak intensities at the Bragg angles (2θ±0.2°) of at least 7.5°, 9.9°, 12.5°, 16.3°, 18.6°, 25.1° and 28.3° with respect to CuKα characteristic X-rays, is used. A mixture including 15 parts by weight of the hydroxygallium phthalocyanine, 10 parts by weight of a vinyl chloride-vinyl acetate copolymer resin (VMCH, manufactured by Nippon Unicar Company Ltd.) and 300 parts by weight of n-butylalcohol is dispersed using a sand mill for 4 hours. The thus obtained dispersion liquid is dip coated on the undercoating layer, and dried at 100° C. for 10 minutes to form a charge-generating layer with a layer thickness of 0.2 μm.

(Charge-Generating Layer 2)

As the charge-generating material, a titanyl phthalocyanine, which has a ionization potential of 5.40 eV and main diffraction peak intensities at the Bragg angles (2θ±0.2°) of at least 7.6°, 18.3°, 23.2°, 24.2°, and 27.3° with respect to CuKα characteristic X-rays, is used. A mixture of 15 parts by weight of the titany phthalocyanine, 10 parts by weight of a vinyl chloride-vinyl acetate copolymer resin (VMCH, manufactured by Nippon Unicar Company Ltd.) and 300 parts by weight of n-butylalcohol is dispersed using a sand mill for 4 hours. The thus obtained dispersion liquid is dip coated on the undercoating layer, and dried at 100° C. for 10 minutes to form a charge-generating layer with a layer thickness of 0.2 μm.

[Formation of Charge-Transporting Layer]

(Charge-Transporting Layer 1)

A coating liquid is prepared by sufficiently dissolving and mixing 38 parts by weight of N,N'-bis(3-methylphenyl)-N,N'-diphenylbenzidine as a charge-transporting material, and 62 parts by weight of bisphenol Z polycarbonate resin (TS2030: viscosity-average molecular weight 30,000: manufactured by Teijin Chemicals Ltd.) in 220 parts by weight of tetrahydrofuran and 70 parts by weight of monochlorobenzene. The prepared coating liquid is dip coated on the aluminum substrate having the undercoating layer and the charge-generating layer, and dried at 125° C. for 60 minutes to form a charge-transporting layer with a layer thickness of 22 μm. Ip of this charge-transporting material is 5.35 eV, and the hole mobility of the charge-transporting layer is $3.5\times10^{-6}$ ($cm^2$/V·sec).

(Charge-Transporting Layer 2)

A charge-transporting layer is formed in the same manner as the charge-transporting layer 1 except that as the charge-transporting material, 35 parts by weight of N,N'-bis(3-methylphenyl)-N,N'-diphenylbenzidine and 65 parts by weight of bisphenol Z polycarbonate resin (TS2030: viscosity-average molecular weight 30,000: manufactured by Teijin Chemicals Ltd.) are used. Ip of this charge-transporting material is 5.35 eV, and the hole mobility of the charge-transporting layer is $1.2\times10^{-6}$ ($cm^2$/V·sec).

(Charge-Transporting Layer 3)

A charge-transporting layer is formed in the same manner as the charge-transporting layer 1 except that as the charge-transporting material, 35 parts by weight of N,N-bis(3,4-dimethylphenyl)biphenyl-4-amine and 65 parts by weight of bisphenol Z polycarbonate resin (TS2030: viscosity-average molecular weight 30,000: manufactured by Teijin Chemicals Ltd.) are used. Ip of this charge-transporting material is 5.46 eV, and the hole mobility of the charge-transporting layer is $3.7\times10^{-6}$ ($cm^2$/V·sec).

(Charge-Transporting Layer 4)

A charge-transporting layer is formed in the same manner as the charge-transporting layer 1 except that as the charge-transporting material, 30 parts by weight of N,N-bis(3,4-dimethylphenyl)biphenyl-4-amine and 70 parts by weight of bisphenol Z polycarbonate resin (TS2030: viscosity-average molecular weight 30,000: manufactured by Teijin Chemicals Ltd.) are used. Ip of this charge-transporting material is 5.46 eV, and the hole mobility of the charge-transporting layer is $1.0\times10^{-6}$ ($cm^2$/V·sec).

(Charge-Transporting Layer 5)

A charge-transporting layer is formed in the same manner as the charge-transporting layer 1 except that as the charge-transporting material, a mixture of 30 parts by weight of N,N-bis(3,4-dimethylphenyl)biphenyl-4-amine and 15 parts by weight of N,N'-bis(3-methylphenyl)-N,N' diphenylbenzidine, and 55 parts by weight of bisphenol Z polycarbonate resin (TS2030: viscosity-average molecular weight 30,000: manufactured by Teijin Chemicals Ltd.) are used. When two kinds of charge-transporting materials are mixed as described above, the value of the material of which the ionization potential is smaller is employed from the viewpoint of the charge injection. Ip of this charge-transporting material is 5.35 eV, and the hole mobility of the charge-transporting layer is $4.8\times10^{-6}$ ($cm^2$/V·sec).

(Charge-Transporting Layer 6)

A charge-transporting layer is formed in the same manner as the charge-transporting layer 1 except that as the charge-transporting material, 40 parts by weight of 9:1 mixture of 4,4'-bis(4,4-diphenyl-1,3-butadienyl)-triphenylamine and 4,4',4"-tris(4,4-diphenyl-1,3-butadienyl)-triphenylamine, and 60 parts by weight of bisphenol Z polycarbonate resin (TS2030: viscosity-average molecular weight 30,000: manufactured by Teijin Chemicals Ltd.) are used. When two kinds of charge-transporting materials are mixed as described above, the value of the material of which the ionization potential is smaller is employed from the viewpoint of the charge injection. Ip of this charge-transporting material is 5.39 eV, and the hole mobility of the charge-transporting layer is $1.9\times10^{-5}$ ($cm^2$/V·sec).

(Charge-Transporting Layer 7)

A charge-transporting layer is formed in the same manner as the charge-transporting layer 1 except that as the charge-transporting material, 35 parts by weight of 9:1 mixture of 4,4'-bis(4,4-diphenyl-1,3-butadienyl)-triphenylamine and 4,4',4"-tris(4,4-diphenyl-1,3-butadienyl)-triphenylamine, and 65 parts by weight of bisphenol Z polycarbonate resin (TS2030: viscosity-average molecular weight 30,000: manufactured by Teijin Chemicals Ltd.) are used. When two kinds of charge-transporting materials are mixed as described above, the value of the material of which the ionization potential is smaller is employed from the viewpoint of the charge injection. Ip of this charge-transporting material is 5.39 eV, and the hole mobility of the charge-transporting layer is $8.7\times10^{-6}$ ($cm^2$/V·sec).

(Charge-Transporting Layer 8)

A charge-transporting layer is formed in the same manner as the charge-transporting layer 1 except that as the charge-transporting material, 35 parts by weight of the compound A represented by the following structural formula and 70 parts by weight of bisphenol Z polycarbonate resin (TS2030: viscosity-average molecular weight 30,000: manufactured by Teijin Chemicals Ltd.) are used. Ip of this charge-transporting material is 5.65 eV, and the hole mobility of the charge-transporting layer is $4.5\times10^{-6}$ ($cm^2$/V·sec).

Compound A

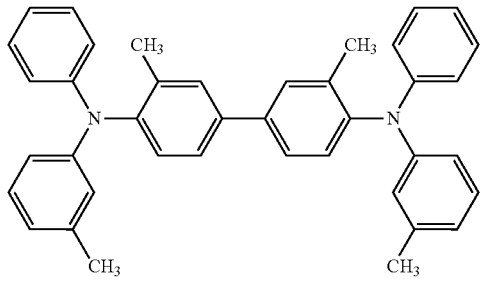

(Charge-Transporting Layer 9)

A charge-transporting layer is formed in the same manner as the charge-transporting layer 1 except that as the charge-transporting material, 37 parts by weight of the compound B represented by the following structural formula and 70 parts by weight of bisphenol Z polycarbonate resin (TS2030: viscosity-average molecular weight 30,000: manufactured by Teijin Chemicals Ltd.) are used. Ip of this charge-transporting material is 5.20 eV, and the hole mobility of the charge-transporting layer is $7.5\times10^{-6}$ ($cm^2/V\cdot sec$).

Compound B

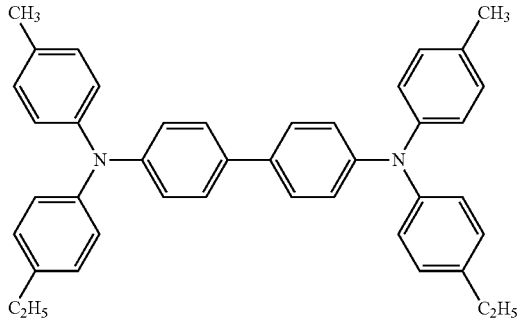

[Formation of Overcoat Layer]

(Overcoat Layer 1)

After causing 90 parts by weight of the compound represented by above (I-19) as the charge-transporting material and 10 parts by weight of the melamine compound represented by above (B)-2 (NIKALAC MW-390 manufactured by Nippon Carbide Industries Co., Inc.) to be dissolved in 200 parts by weight of t-BuOH, 0.5 parts by weight of dodecyl benzenesulfonic acid (NACURE 5225 manufactured by King Industries Inc.) is added. The thus obtained coating liquid is dip coated on the aluminum substrate having the undercoating layer, the charge-generating layer and the charge-transporting layer, and dried at 160° C. for 40 minutes to form an overcoat layer with a layer thickness of 5 μm. The ionization potential of the compound represented by above (I-19) is 5.53 eV.

(Overcoat Layer 2)

After causing 93 parts by weight of the compound represented by above (I-26) as the charge-transporting material and 7 parts by weight of the melamine compound represented by above (B)-2 (NIKALAC MW-390 manufactured by Nippon Carbide Industries Co., Inc.) to be dissolved in 200 parts by weight of t-BuOH, 0.5 parts by weight of dodecyl benzenesulfonic acid (NACURE 5225 manufactured by King Industries Inc.) is added. The thus obtained coating liquid is dip coated on the aluminum substrate having the undercoating layer, the charge-generating layer and the charge-transporting layer, and dried at 160° C. for 40 minutes to form an overcoat layer with a layer thickness of 5 μm. The ionization potential of the compound represented by above (I-26) is 5.44 eV.

(Overcoat Layer 3)

After causing 95 parts by weight of the compound represented by above (I-8) as the charge-transporting material and 5 parts by weight of the melamine compound represented by above (B)-2 (NIKALAC MW-390 manufactured by Nippon Carbide Industries Co., Inc.) to be dissolved in 200 parts by weight of t-BuOH, 0.5 parts by weight of dodecyl benzenesulfonic acid (NACURE 5225 manufactured by King Industries Inc.) is added. The thus obtained coating liquid is dip coated on the aluminum substrate having the undercoating layer, the charge-generating layer and the charge-transporting layer, and dried at 160° C. for 40 minutes to form an overcoat layer with a layer thickness of 5 μm. The ionization potential of the compound represented by above (I-8) is 5.77 eV.

(Overcoat Layer 4)

After causing 45 parts by weight of the compound represented by above (I-8) and 45 parts by weight of the compound represented by above (I-16) as the charge-transporting materials, and 10 parts by weight of the melamine compound represented by above (B)-2 (NIKALAC MW-390 manufactured by Nippon Carbide Industries Co., Inc.) to be dissolved in 200 parts by weight of t-BuOH, 0.5 parts by weight of dodecyl benzenesulfonic acid (NACURE 5225 manufactured by King Industries Inc.) is added. The thus obtained coating liquid is dip coated on the aluminum substrate having the undercoating layer, the charge-generating layer and the charge-transporting layer, and dried at 160° C. for 40 minutes to form an overcoat layer with a layer thickness of 5 μm. When two kinds of charge-transporting materials are mixed as described above, the value of the material of which the ionization potential is smaller is employed from the viewpoint of the charge injection. IP of the compound represented by above (I-16) is 5.50 eV.

Example 1

100 parts by weight of zinc oxide (average particle diameter 70 nm: manufactured by Tayca Corporation) is mixed and stirred with 500 parts by weight of toluene, 1.5 parts by weight of silane coupling agent (KBM603: manufactured by Shin-Etsu Chemical Co., Ltd.) is then added, and the resulting mixture is stirred for 2 hours. Thereafter, toluene is distilled away in a reduced-pressure distillation, and the resulting product is sintered at 150° C. for 2 hours.

60 parts by weight of the surface-treated zinc oxide, 15 parts by weight of curing agent (blocked isocyanate SUMIDUR 3175: manufactured by Sumitomo Bayer Urethane Co., Ltd.), 38 parts by weight of a solution obtained by dissolving 15 parts by weight of butyral resin "S-LEC BM-1" manufactured by Sekisui Chemical Co., Ltd. in 85 parts by weight of methyl ethyl ketone, and 25 parts by weight of methyl ethyl ketone are mixed, and dispersion treatment is carried out with glass beads of 1 mmϕ by a sand mill for 2 hours to obtain a dispersion liquid. Then, 0.005 parts by weight of dioctyltin dilaurate is added as a catalyst to the thus obtained dispersion liquid to obtain a coating liquid for the undercoating layer.

An aluminum substrate with a diameter of 84 mm, a length of 340 mm, and a thickness of 1 mm is coated with this coating liquid in a dip-coating method, and dried and cured at 175° C. for 40 minutes to obtain an undercoating layer for Evaluation 1 with a thickness of 20 μm.

In addition, an aluminum substrate with a diameter of 30 mm, a length of 404 mm, and a thickness of 1 mm is coated with the coating liquid, and dried and cured at 175° C. for 40 minutes to obtain an undercoating layer for Evaluation 2 with a thickness of 20 μm.

Next, the charge-generating layer 1, the charge-transporting layer 1, and the overcoat layer 1, which have been described above in the formation of the respective layers, are sequentially formed on each aluminum substrate with the undercoating layer formed thereon.

The electrophotographic photoreceptor is obtained as described above.

Examples 2 to 11, Comparative Examples 1 to 5

As in Example 1, the charge-generating layer, the charge-transporting layer, and the overcoat layer, which have been described above in the formation of the respective layers, are sequentially formed on each aluminum substrate with the undercoating layer formed thereon in accordance with Table 1, thereby obtaining each electrophotographic photoreceptor.

[Evaluation 1]

The thus obtained electrophotographic photoreceptor (electrophotographic photoreceptor on which the undercoating layer for Evaluation 1 has been formed) is mounted on the DOCUCENTRE 1010 manufactured by Fuji Xerox Co., Ltd., and 30,000 sheets/day of images are printed under the conditions of a high temperature of 28° C. and a high humidity of 80% for 5 days such that a total of 150,000 sheets of images are printed. The residual potential of the electrophotographic photoreceptor is measured with an electrometer installed in the DOCUCENTRE 1010 while the printing operation is being performed. In addition, the qualities of the printed images are evaluated.

Table 2 shows the results.

[Evaluation 2]

The thus obtained electrophotographic photoreceptor (electrophotographic photoreceptor on which the undercoating layer for Evaluation 2 has been formed) is mounted on the DOCUCENTRE COLOR 400 manufactured by Fuji Xerox Co., Ltd., and a blank image is printed at the lowest speed of 52 mm/s under the conditions of a high temperature of 28° C. and a high humidity of 80% to evaluate the qualities (fogging) of the printed image.

Table 2 shows the results.

—Residual Potential of Electrophotographic Photoreceptor—

The evaluation is made for the residual potential of the electrophotographic photoreceptor with the following evaluation criteria.

A: 80 V or less

B: more than 80 V but not more than 120 V

C: more than 120V but not more than 160 V

D: more than 160 V

—Evaluation of Image Quality—

As for Evaluation 1 for the image quality, half tone printing at the densities of 20%, 40%, and 60% is performed with the DOCUCENTRE 1010, and as the image quality after printing of 150,000 sheets, the evaluation is made with the following criteria for the density unevenness caused by the increase in the residual potential.

A: no density unevenness is observed

B: a little density unevenness is observed (no problem in practical use)

C: density unevenness is observed (cannot be practically used)

As for Evaluation 2 for the image quality, a blank image is printed at the lowest process speed of 52 mm/s with the DOCUCENTRE COLOR 400, and the evaluation is made with the following criteria for the existence of the fogging.

A: No fogging is observed

B: A little fogging is observed (no problem in practical use)

C: Fogging is observed (cannot be practically used)

TABLE 1

| | Charge-Generating Layer | | Charge-Transporting Layer | | | Overcoat Layer | | | |
|---|---|---|---|---|---|---|---|---|---|
| | Type | Ip (CGL) | Type | Ip (CTL) | Hole Mobility ($cm^2$/V · sec) | Type | Ip (OCL) | \|Ip (OCL) − Ip (CTL)\| | \|Ip (CTL) − Ip (CGL)\| |
| Example 1 | Charge-Generating Layer 1 | 5.31 eV | Charge-Transporting Layer 1 | 5.35 eV | $3.5 \times 10^{-6}$ | Overcoat Layer 1 | 5.53 eV | 0.18 eV | 0.04 eV |
| Example 2 | Charge-Generating Layer 1 | 5.31 eV | Charge-Transporting Layer 2 | 5.35 eV | $1.2 \times 10^{-6}$ | Overcoat Layer 4 | 5.50 eV | 0.15 eV | 0.04 eV |
| Example 3 | Charge-Generating Layer 1 | 5.31 eV | Charge-Transporting Layer 4 | 5.46 eV | $1.0 \times 10^{-6}$ | Overcoat Layer 1 | 5.53 eV | 0.07 eV | 0.15 eV |
| Example 4 | Charge-Generating Layer 1 | 5.31 eV | Charge-Transporting Layer 5 | 5.35 eV | $4.8 \times 10^{-6}$ | Overcoat Layer 1 | 5.53 eV | 0.18 eV | 0.04 eV |
| Example 5 | Charge-Generating Layer 1 | 5.31 eV | Charge-Transporting Layer 1 | 5.35 eV | $3.5 \times 10^{-6}$ | Overcoat Layer 2 | 5.44 eV | 0.09 eV | 0.04 eV |

TABLE 1-continued

| | Charge-Generating Layer | | Charge-Transporting Layer | | | Overcoat Layer | | | |
|---|---|---|---|---|---|---|---|---|---|
| | Type | Ip (CGL) | Type | Ip (CTL) | Hole Mobility ($cm^2$/V · sec) | Type | Ip (OCL) | \|Ip (OCL) − Ip (CTL)\| | \|Ip (CTL) − Ip (CGL)\| |
| Example 6 | Charge-Generating Layer 1 | 5.31 eV | Charge-Transporting Layer 1 | 5.35 eV | $3.5 \times 10^{-6}$ | Overcoat Layer 4 | 5.50 eV | 0.15 eV | 0.04 eV |
| Example 7 | Charge-Generating Layer 2 | 5.40 eV | Charge-Transporting Layer 4 | 5.46 eV | $1.0 \times 10^{-6}$ | Overcoat Layer 1 | 5.53 eV | 0.07 eV | 0.06 eV |
| Example 8 | Charge-Generating Layer 1 | 5.31 eV | Charge-Transporting Layer 1 | 5.35 eV | $3.5 \times 10^{-6}$ | Overcoat Layer 3 | 5.77 eV | 0.42 eV | 0.04 eV |
| Example 9 | Charge-Generating Layer 2 | 5.40 eV | Charge-Transporting Layer 8 | 5.65 eV | $4.5 \times 10^{-6}$ | Overcoat Layer 3 | 5.77 eV | 0.12 eV | 0.25 eV |
| Example 10 | Charge-Generating Layer 1 | 5.31 eV | Charge-Transporting Layer 8 | 5.65 eV | $4.5 \times 10^{-6}$ | Overcoat Layer 3 | 5.77 eV | 0.12 eV | 0.34 eV |
| Example 11 | Charge-Generating Layer 1 | 5.31 eV | Charge-Transporting Layer 4 | 5.46 eV | $1.0 \times 10^{-6}$ | Overcoat Layer 3 | 5.77 eV | 0.31 eV | 0.15 eV |
| Comparative Example 1 | Charge-Generating Layer 1 | 5.31 eV | Charge-Transporting Layer 6 | 5.39 eV | $1.9 \times 10^{-5}$ | Overcoat Layer 1 | 5.53 eV | 0.14 eV | 0.08 eV |
| Comparative Example 2 | Charge-Generating Layer 1 | 5.31 eV | Charge-Transporting Layer 7 | 5.39 eV | $8.7 \times 10^{-6}$ | Overcoat Layer 1 | 5.53 eV | 0.14 eV | 0.08 eV |
| Comparative Example 3 | Charge-Generating Layer 1 | 5.31 eV | Charge-Transporting Layer 9 | 5.20 eV | $7.5 \times 10^{-6}$ | Overcoat Layer 1 | 5.53 eV | 0.33 eV | 0.11 eV |
| Comparative Example 4 | Charge-Generating Layer 1 | 5.31 eV | Charge-Transporting Layer 3 | 5.46 eV | $3.7 \times 10^{-6}$ | Overcoat Layer 2 | 5.44 eV | 0.02 eV | 0.15 eV |
| Comparative Example 5 | Charge-Generating Layer 2 | 5.40 eV | Charge-Transporting Layer 1 | 5.35 eV | $3.5 \times 10^{-6}$ | Overcoat Layer 2 | 5.44 eV | 0.09 eV | 0.05 eV |

TABLE 2

| | Evaluation 1 | | Evaluation 2 |
|---|---|---|---|
| | Residual Potential After Printing of 150,000 Sheets | Image Quality After Printing of 150,000 Sheets (Half Tone) | Image Quality at Lowest Process Speed (Fogging) |
| Example 1 | A | A | A |
| Example 2 | A | A | A |
| Example 3 | A | A | A |
| Example 4 | A | A | A |
| Example 5 | A | A | A |
| Example 6 | A | A | A |
| Example 7 | A | A | A |
| Example 8 | B | A | A |
| Example 9 | B | A | A |
| Example 10 | B | A | A |
| Example 11 | B | A | A |
| Comparative Example 1 | D | C | C |
| Comparative Example 2 | C | B | C |
| Comparative Example 3 | D | C | C |
| Comparative Example 4 | C | C | B |
| Comparative Example 5 | C | C | B |

It can be understood from the above results that the satisfactory results for the residual potential of the electrophotographic photoreceptor and the image quality may be achieved in Examples as compared with Comparative Examples.

In addition, it can be understood from the comparison between Evaluation 1 and Evaluation 2 that it is possible to achieve the satisfactory results for the residual potential of the electrophotographic photoreceptor and the image quality even when the Examples are applied to an image forming apparatus of which the process speed is slow.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

a photosensitive layer including a charge-generating layer containing a charge-generating material and a charge-transporting layer containing a first charge-transporting material, the charge-transporting layer having a hole mobility of $5.0 \times 10^{-6}$ ($cm^2$/V·sec) or less at an electric field of 2 V/cm; and an overcoat layer that is provided on the photosensitive layer and contains a cured material of at least one compound and at least one second charge-transporting material, the at least one compound being selected from a group consisting of guanamine compounds and melamine compounds, the at least one second charge-transporting material having at least one substituent selected from a group consisting of —OH, —$OCH_3$, —$NH_2$, —SH, and —COOH, a content of the at least one compound in the overcoat layer being in a range from 0.1% by weight to 5% by weight, and a content of the at least one second charge-transporting material in the overcoat layer being in a range from 90% by weight to less than 99.9% by weight;

wherein the following relational expression (1) is satisfied $$Ip(OCL)>Ip(CTL)>Ip(CGL) \quad (1)$$

wherein Ip(CGL) represents an ionization potential (eV) of the charge-generating material; Ip(CTL) represents an ionization potential (eV) of the first charge-transporting material; and Ip(OCL) represents an ionization potential (eV) of the at least one second charge-transporting material.

2. The electrophotographic photoreceptor according to claim 1, wherein the following relational expressions (2) and (3) are satisfied $$|Ip(OCL)-Ip(CTL)|\leqq 0.4\ (eV) \quad (2)$$

$$|Ip(CTL)-Ip(CGL)|\leqq 0.3\ (eV) \quad (3).$$

3. The electrophotographic photoreceptor according to claim 1, wherein the content of the at least one compound in the overcoat layer is in a range from 1% by weight to 3% by weight.

4. The electrophotographic photoreceptor according to claim 1, wherein the at least one compound includes a guanamine compound, and the guanamine compound is a compound represented by the following formula (A) or an oligomer thereof (A)

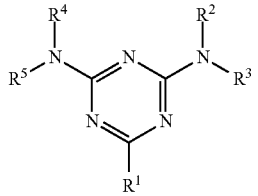

wherein $R^1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms; $R^2$ to $R^5$ each independently represent a hydrogen atom, —$CH_2$—OH, or —$CH_2$—O—$R^6$; and $R^6$ represents a linear or branched alkyl group having from 1 to 10 carbon atoms.

5. The electrophotographic photoreceptor according to claim 1, wherein the at least one compound includes a melamine compound, and the melamine compound is a compound represented by the following formula (B) or an oligomer thereof (B)

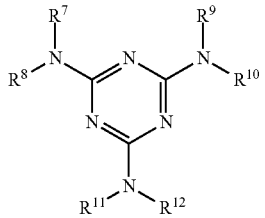

wherein $R^7$ to $R^{12}$ each independently represent a hydrogen atom, —$CH_2$—OH, —$CH_2$—O—$R^{13}$, or —O—$R^{14}$; and $R^{13}$ and $R^{14}$ each independently represent an alkyl group that has from 1 to 5 carbon atoms and may be branched.

6. The electrophotographic photoreceptor according to claim 1, wherein the at least one second charge-transporting material includes a compound represented by the following formula (I)

$$F(—(R^{15}—X)_{n1}—(R^{16})_{n2}—Y)_{n3} \quad (I)$$

wherein F represents an organic group derived from a compound having a hole transporting ability; $R^{15}$ and $R^{16}$ each independently represent a linear or branched alkylene group having from 1 to 5 carbon atoms; n1 represents 0 or 1; n2 represents 0 or 1; n3 represents an integer from 1 to 4; X represents an oxygen atom, NH, or a sulfur atom; and Y represents —OH, —$OCH_3$, —$NH_2$, —SH, or —COOH.

7. A process cartridge comprising the electrophotographic photoreceptor according to claim 1, wherein the process cartridge is attachable to and detachable from an image forming apparatus for forming an image on a recording medium.

8. The process cartridge according to claim 7, wherein the following relational expressions (2) and (3) are satisfied in the electrophotographic photoreceptor $$|Ip(OCL)-Ip(CTL)|\leqq 0.4\ (eV) \quad (2)$$

$$|Ip(CTL)-Ip(CGL)|\leqq 0.3\ (eV). \quad (3)$$

9. The process cartridge according to claim 7, wherein the content of the at least one compound in the overcoat layer is in a range from 1% by weight to 3% by weight.

10. An image forming apparatus comprising:

the electrophotographic photoreceptor according to claim 1;

a charging unit that charges the electrophotographic photoreceptor;

a latent image forming unit that forms an electrostatic latent image on a surface of the charged electrophotographic photoreceptor;

a development unit that develops the electrostatic latent image formed on the surface of the electrophotographic photoreceptor with a toner to form a toner image; and a transfer unit that transfers the toner image formed on the surface of the electrophotographic photoreceptor onto a recording medium.

11. The image forming apparatus according to claim 10, wherein the following relational expressions (2) and (3) are satisfied in the electrophotographic photoreceptor $$|Ip(OCL)-Ip(CTL)|\leqq 0.4\ (eV) \quad (2)$$

$$|Ip(CTL)-Ip(CGL)|\leqq 0.3\ (eV). \quad (3)$$

12. The image forming apparatus according to claim 10, wherein the content of the at least one compound in the overcoat layer is in a range from 1% by weight to 3% by weight.

* * * * *